US011596232B2

(12) United States Patent
Goetz et al.

(10) Patent No.: US 11,596,232 B2
(45) Date of Patent: Mar. 7, 2023

(54) CHAIR FOR ACTIVE ENGAGEMENT OF USER

(71) Applicant: Herman Miller, Inc., Zeeland, MI (US)

(72) Inventors: Mark Goetz, Brooklyn, NY (US); Brock Walker, Okemos, MI (US); John Aldrich, Grandville, MI (US); Andy Squires, Grandville, MI (US); Chris Holwerda, Hudsonville, MI (US); Adwait Bhagwat, Holland, MI (US)

(73) Assignee: MillerKnoll, Inc., Zeeland, MI (US)

( * ) Notice: Subject to any disclaimer, the term of this patent is extended or adjusted under 35 U.S.C. 154(b) by 0 days.

(21) Appl. No.: 17/604,261

(22) PCT Filed: Apr. 15, 2020

(86) PCT No.: PCT/US2020/028319

§ 371 (c)(1),
(2) Date: Oct. 15, 2021

(87) PCT Pub. No.: WO2020/214702

PCT Pub. Date: Oct. 22, 2020

(65) Prior Publication Data

US 2022/0087424 A1 Mar. 24, 2022

Related U.S. Application Data

(60) Provisional application No. 62/834,780, filed on Apr. 16, 2019.

(51) Int. Cl.
*A47C 1/03* (2006.01)
*A47C 1/032* (2006.01)
(Continued)

(52) U.S. Cl.
CPC ..... *A47C 1/03255* (2013.01); *A47C 1/03274* (2018.08); *A47C 7/14* (2013.01); *A47C 7/46* (2013.01)

(58) Field of Classification Search
CPC ..... A47C 1/03255; A47C 1/03266; A47C 1/03274; A47C 1/03272; A47C 1/03277;
(Continued)

(56) References Cited

U.S. PATENT DOCUMENTS 282,371 A 7/1883 Rintelman
476,805 A 6/1892 Mason
(Continued)

FOREIGN PATENT DOCUMENTS

CA 1039638 A 10/1978
DE 4239548 A1 4/1993
(Continued)

OTHER PUBLICATIONS

International Search Report with Written Opinion for related Application No. PCT/US2016/043905 dated Nov. 1, 2016 (14 pages).
(Continued)

*Primary Examiner* — Mark R Wendell
(74) *Attorney, Agent, or Firm* — Michael Best & Friedrich LLP

(57) ABSTRACT

A chair includes a lower chair and an upper chair. The lower chair includes a tilt-swivel mechanism defining a vertical swivel axis, a yoke, and a column extending between the tilt-swivel mechanism and the yoke. The upper chair is pivotably mounted to the yoke about a horizontal upper chair pivot axis. The upper chair includes a seat adapted to cradle the ischial tuberosities of a user.

58 Claims, 21 Drawing Sheets

(51) Int. Cl.
*A47C 7/14* (2006.01)
*A47C 7/46* (2006.01)

(58) Field of Classification Search
CPC .. A47C 1/14; A47C 1/46; A47C 1/022; A47C 7/54; A47C 7/40; A47C 3/185; A47C 3/027; A47C 3/0255; A47C 3/30; A47C 3/18
USPC ..... 297/300.2
See application file for complete search history.

(56) References Cited

U.S. PATENT DOCUMENTS

| | | | |
|---|---|---|---|
| 517,929 | A | 4/1894 | March |
| 3,434,755 | A | 3/1969 | Caldemeyer et al. |
| 3,446,532 | A | 5/1969 | Cramer |
| 3,464,736 | A | 9/1969 | Mizelle |
| 3,480,249 | A | 11/1969 | Lie |
| 4,099,697 | A | 7/1978 | Von Schuckmann |
| 4,131,260 | A | 12/1978 | Ambasz |
| 4,183,579 | A | 1/1980 | Gonzalez |
| 4,451,086 | A | 5/1984 | Seven |
| 4,521,053 | A | 6/1985 | deBoer |
| 4,575,151 | A | 3/1986 | Edstrom |
| 4,641,885 | A | 2/1987 | Brauning |
| 4,650,249 | A | 3/1987 | Serber |
| D289,708 | S | 5/1987 | Rykken |
| 4,682,814 | A | 7/1987 | Hansen |
| 4,718,726 | A | 1/1988 | Estkowski et al. |
| 4,765,684 | A | 8/1988 | Kvalheim et al. |
| 4,796,950 | A | 1/1989 | Mrotz, III et al. |
| 4,872,727 | A | 10/1989 | Rye |
| 4,932,719 | A | 6/1990 | Gonzalez |
| 5,244,252 | A | 9/1993 | Serber |
| 5,401,077 | A | 3/1995 | Hosoe |
| 5,435,623 | A | 7/1995 | Kapec et al. |
| 5,536,067 | A | 7/1996 | Pinto |
| 5,558,399 | A | 9/1996 | Serber |
| 5,590,930 | A | 1/1997 | Glocki |
| 5,636,898 | A | 6/1997 | Dixon et al. |
| 5,653,505 | A | 8/1997 | Holobaugh, Jr. |
| 5,716,099 | A | 2/1998 | McDiarmid |
| 5,725,276 | A | 3/1998 | Ginat |
| 5,735,574 | A | 4/1998 | Serber |
| 6,039,397 | A | 3/2000 | Ginat |
| 6,070,937 | A | 6/2000 | Ginat |
| 6,092,870 | A | 7/2000 | Desnoyers et al. |
| 6,120,094 | A | 9/2000 | Parent |
| 620,335 | A1 | 3/2001 | Huber et al. |
| 6,206,335 | B1 | 3/2001 | Huber et al. |
| 6,386,634 | B1 | 5/2002 | Stumpf et al. |
| 6,601,818 | B1 | 8/2003 | Larsen |
| 6,669,292 | B2 | 12/2003 | Koepke et al. |
| 6,869,142 | B2 | 3/2005 | Heidmann et al. |
| 6,945,602 | B2 | 9/2005 | Fookes et al. |
| 6,957,863 | B2 | 10/2005 | Heidmann et al. |
| 7,081,075 | B2 | 7/2006 | Sachs |
| 7,134,720 | B2 | 11/2006 | Viger |
| 7,207,629 | B2 | 4/2007 | Goetz et al. |
| 7,234,774 | B2 | 6/2007 | Heidmann et al. |
| 7,234,775 | B2 | 6/2007 | Serber |
| 7,350,863 | B2 | 4/2008 | Engels et al. |
| 7,478,878 | B2 | 1/2009 | Oettinger |
| 7,500,718 | B2 | 3/2009 | Fookes et al. |
| 7,547,067 | B2 | 6/2009 | Keilhauer et al. |
| 7,780,230 | B2 | 8/2010 | Serber |
| 7,841,666 | B2 | 11/2010 | Schmitz et al. |
| 7,878,591 | B2 | 2/2011 | Walker et al. |
| 8,066,624 | B1 | 11/2011 | Stroup |
| 8,419,133 | B2 | 4/2013 | Holt et al. |
| 8,540,314 | B2 | 9/2013 | Fernandez |
| 8,662,586 | B2 | 3/2014 | Serber |
| 8,864,230 | B2 | 10/2014 | Augustat |
| 8,888,181 | B2 | 11/2014 | Perraut et al. |
| 8,944,507 | B2 | 2/2015 | Goetz |
| 9,044,097 | B1 | 6/2015 | Ardrey |
| 9,185,973 | B2 | 11/2015 | Udagawa et al. |
| 9,320,318 | B2 | 4/2016 | Nurse et al. |
| D758,747 | S | 6/2016 | Lenz et al. |
| 9,380,831 | B2 | 7/2016 | Craig et al. |
| 9,399,415 | B2 | 7/2016 | Serber |
| 9,402,440 | B2 | 8/2016 | Diepenbrock |
| D803,592 | S | 11/2017 | Lenz et al. |
| 2002/0190553 | A1 | 12/2002 | Koepke et al. |
| 2003/0001420 | A1 | 1/2003 | Koepke et al. |
| 2003/0071502 | A1 | 4/2003 | Marshall et al. |
| 2003/0132653 | A1 | 7/2003 | Thole |
| 2004/0051362 | A1 | 3/2004 | Heidmann et al. |
| 2004/0195881 | A1 | 10/2004 | Wells |
| 2005/0022305 | A1* | 2/2005 | Bieganek ..... A61G 5/1043 5/652 |
| 2005/0029848 | A1 | 2/2005 | Heidmann et al. |
| 2005/0225140 | A1* | 10/2005 | Kneeshaw ..... A47C 7/46 297/284.4 |
| 2006/0055220 | A1 | 3/2006 | Heidmann et al. |
| 2006/0138840 | A1 | 6/2006 | Keilhauer et al. |
| 2006/0175884 | A1 | 8/2006 | Jenkins |
| 2007/0085408 | A1 | 4/2007 | Kohani |
| 2008/0211277 | A1* | 9/2008 | Goetz ..... A47C 7/46 297/230.14 |
| 2009/0140567 | A1 | 6/2009 | Weiss |
| 2011/0101748 | A1 | 5/2011 | Goetz |
| 2011/0175414 | A1 | 7/2011 | Asbjornsen |
| 2011/0304192 | A1 | 12/2011 | Augustat |
| 2012/0216347 | A1 | 8/2012 | Tundo et al. |
| 2012/0304370 | A1 | 12/2012 | Gianfagna et al. |
| 2013/0306831 | A1 | 11/2013 | Keen et al. |
| 2015/0196123 | A1 | 7/2015 | Buehrer |
| 2015/0201758 | A1 | 7/2015 | Serber |
| 2015/0245713 | A1* | 9/2015 | Desanta ..... A47C 7/44 297/316 |
| 2016/0015179 | A1 | 1/2016 | Bonneywell |
| 2016/0073786 | A1 | 3/2016 | Walker et al. |
| 2016/0157618 | A1 | 6/2016 | Arnett |
| 2016/0360889 | A1 | 12/2016 | Matlin et al. |
| 2017/0007026 | A1 | 1/2017 | Avery |
| 2017/0020292 | A1 | 1/2017 | Walker et al. |
| 2018/0020831 | A1 | 1/2018 | Lenz |

FOREIGN PATENT DOCUMENTS

| | | | |
|---|---|---|---|
| DE | 102012212121 | A1 | 1/2014 |
| DE | D102009010183 | A1 | 8/2018 |
| GB | 2167947 | A | 6/1986 |
| JP | S6452536 | A | 2/1989 |
| JP | 2001506149 | A | 5/2001 |
| JP | 2014004324 | A | 10/2004 |
| JP | 2007268118 | A | 1/2014 |
| KR | 20130096520 | A | 8/2013 |
| KR | 101333318 | B1 | 11/2013 |
| WO | 8910080 | A1 | 11/1989 |
| WO | WO1997046144 | A1 | 12/1997 |
| WO | WO2012170863 | A3 | 4/2013 |
| WO | WO2014009147 | A1 | 1/2014 |
| WO | WO2014179815 | A1 | 11/2014 |
| WO | WO2017132240 | A1 | 8/2017 |

OTHER PUBLICATIONS

International Search Report with Written Opinion for related Application No. PCT/US2020/028319 dated Aug. 25, 2020 (16 Pages).
Herman Miller Aeron Office Chair Review, website:https://www.youtube.com/watch?v=iN61R6RcZcU, Dated Feb. 21, 2019 (4 Screenshots).
Best Ergonomic, "Swing Chair", Website: http://www.swingchair.com Dated Aug. 11, 2016 (6 Pages).
Extended European Search Report for Application No. 20791550.5 dated Dec. 12, 2022 (7 Pages).

* cited by examiner

CHAIR FOR ACTIVE ENGAGEMENT OF USER

BACKGROUND

The present invention relates to a chair that promotes active engagement of selected muscles of the user.

SUMMARY

Various aspects of the invention are described in the claims section which is incorporated in this Summary section by reference.

In one aspect, the invention provides an upper chair adapted to be supported by a lower chair, the upper chair comprising: a seat adapted to cradle the ischial tuberosities of a user, wherein a horizontal upper chair pivot axis is the sole pivotal interconnection between the upper chair and lower chair.

In some embodiments, the upper chair includes a back and the horizontal upper chair pivot axis is above the seat and forward of the back. In some embodiments, the invention further comprises a back extending up with respect to the seat, at least a portion of the back having a 21° range of pivotable motion with respect to the seat. In some embodiments, the invention further comprises a back extending up with respect to the seat, the upper chair pivot axis being forward of the back. In some embodiments, the seat comprises a pelvic nest for cradling ischial tuberosities of a user, a thigh pad engaging the user's posterior thighs forward of the pelvic nest, and a thigh relief interconnecting the pelvic nest and the thigh pad for permitting compliant deflection of the thigh pad with respect to the pelvic nest, the upper chair further comprising: a back pad assembly extending up with respect to the seat and including upper and lower portions, the lower portion of the back pad assembly supported by the lower back support, the lower back support being pivotable to move the lower portion of the back pad assembly respect to the thoracic support and the pelvic nest. In some embodiments, the thigh pad pivots downward with respect to the pelvic nest no more than 45°. In some embodiments, the pelvic nest positions the user's ischial tuberosities below the upper chair pivot axis. In some embodiments, the thigh relief distributes and reduces pressures on portions of the user's posterior thighs positioned over the thigh relief. In some embodiments, an ingress condition of the upper chair comprises the thigh pad being pivoted downward with respect to the pelvic nest and the lower back support and lower portion of the back pad assembly being pivoted rearward with respect to the pelvic nest; and an engaged condition of the chair comprises the thigh pad being pivoted upward with respect to the pelvic nest and the lower back support and lower portion of the back pad assembly being pivoted forward with respect to the pelvic nest. In some embodiments, when the chair is in the engaged condition the thigh pad applies dynamic pressure on the user's posterior thighs to activate muscles in the user's thighs and thereby assist the user to naturally leverage and balance a torso, spine, and pelvis of the user in a neutral posture. In some embodiments, when the chair is in the engaged condition the lower portion of the back pad assembly applies dynamic pressure on the user's sacrum to resist posterior rotation of the user's pelvis. In some embodiments, the invention further comprises a thigh return spring biasing the thigh pad into the ingress position and a sacral return spring biasing the lower back support into the ingress position. In some embodiments, the lower portion of the back pad assembly is pivotably and slidably mounted to the lower back support about a sliding lower back pivot axis; and pivotal movement of the lower back support member applies a linear force on the lower portion of the back pad assembly perpendicular to the sacral sliding pivot axis to move the lower portion of the back pad assembly between the ingress position and engaged position. In some embodiments, the sacral sliding pivot axis is horizontal and coincident to a center of pressure applied to the lower portion of the back pad assembly by the user such that the lower portion of the back pad assembly is free to pivot about the sacral sliding pivot axis to orient the lower portion of the back pad assembly to an angle of the user's sacrum. In some embodiments, the invention further comprises a pulley mounted under the pelvic nest, a nesting cable interconnected at opposite ends to the thigh pad and the lower back support, the nesting cable extending over the pulley such that downward force on the pelvic nest arising from the user sitting in the pelvic nest generates tension in the nesting cable to pivot each of the thigh pad and the lower back support into the engaged condition. In some embodiments: the lower back support pivots about a posterior pivot axis below and rearward of the upper chair pivot axis; the lower back support includes a lower back cam surface through which the posterior pivot axis extends; a first end of the nesting cable is connected to the lower back support; and the nesting cable engages the lower back cam surface such that tension in the nesting cable generates a moment on the lower back support about the posterior pivot axis to move the lower portion of the back pad assembly into the engaged position. In some embodiments, the lower back support has a 21° range of pivotable motion with respect to the posterior pivot axis. In some embodiments, the upper chair includes a body support frame pivotably mounted to the lower chair about the upper chair pivot axis, the body support frame extending below the seat and behind the back, the seat being supported by the body support frame, the upper portion of the back pivoting with respect to the body support frame about the thoracic pivot axis. In some embodiments, the invention further comprises a thigh support pivotably interconnected to the body support frame about a horizontal hip pivot axis that is below and forward of the upper chair pivot axis, the thigh pad being interconnected with the thigh support via a thigh pad sliding pivot axis under the thigh pad to enable relative rotation and translation between the thigh pad and thigh support. In some embodiments: the thigh support includes a hip cam surface that is eccentrically positioned on the hip pivot axis; a second end of the nesting cable connects to the thigh support; and the nesting cable engages the hip cam surface such that tension in the nesting cable generates a moment on the thigh support about the hip pivot axis to move the thigh pad into the engaged position. In some embodiments, the invention further comprises at least one travel stop for limiting the total rotation of the of the body support frame with respect to the yoke about the upper chair pivot axis to a total range of 12°.

In another aspect, the invention provides a chair comprising: a lower chair including a tilt-swivel mechanism defining a vertical swivel axis, a yoke, and a column extending between the tilt-swivel mechanism and the yoke; and an upper chair pivotably mounted to the yoke about a horizontal upper chair pivot axis, the upper chair including a seat adapted to cradle the ischial tuberosities of a user.

In some embodiments, the tilt-swivel mechanism includes a four-bar linkage rotatable about the swivel axis, the four-bar linkage including a coupler member that moves about a coupler curve; and a bottom end of the column is supported by the coupler member for movement with the coupler member about the coupler curve and rotation about the swivel axis. In some embodiments, the column defines a longitudinal axis angled with respect to the swivel axis and intersecting the swivel axis. In some embodiments, the column is locked with respect to the tilt-swivel mechanism against rotation about the longitudinal axis. In some embodiments, the tilt-swivel mechanism provides independent swivel and tilting actions for the column. In some embodiments, a tilting range of motion of the column on the tilt-swivel mechanism is limited to between 80-90° with respect to horizontal. In some embodiments, a tilting range of motion of the column on the tilt-swivel mechanism is limited to between 82-87° with respect to horizontal. In some embodiments, the tilt-swivel mechanism permits 360° of column swivel about the swivel axis. In some embodiments, the column is a height-adjustable column permitting adjustment of a distance between the yoke and the tilt-swivel mechanism. In some embodiments, the height-adjustable column accommodates users between the 5th and 95th percentile of sizes. In some embodiments, the height-adjustable column enables the user to sit in multiple tilted positions with a thigh-to-torso angle in the range of 90° to 130°. In some embodiments, the invention further comprises a dampener between the column and tilt-swivel mechanism for controlling a rate of tilting motion of the column on the tilt-swivel mechanism and a dampener between the yoke and upper chair for controlling a rate of tilting motion of the upper chair with respect to the yoke about the upper pivot axis. In some embodiments, the lower chair further comprises a base onto which the tilt-swivel mechanism is mounted and casters supporting the base above a floor, the casters enabling rolling motion of the chair on the floor. In some embodiments, a center of mass of the user is maintained over the base through a full range of motion afforded by the tilt-swivel mechanism. In some embodiments, the invention further comprises a biasing mechanism for moving the column into an at-rest position when the seat is not occupied by a user. In some embodiments, the horizontal upper chair pivot axis is above the seat. In some embodiments, the upper chair pivot axis is the sole pivotal interconnection between the upper chair and lower chair. In some embodiments, a pivoting motion of the upper chair about the upper chair pivot axis is independent of tilt and swivel motions of the support column on the tilt-swivel mechanism. In some embodiments, the upper chair further comprises a back extending up with respect to the seat, at least a portion of the back having a 21° range of pivotable motion with respect to the seat. In some embodiments, the upper chair further comprises a back extending up with respect to the seat, the upper chair pivot axis being forward of the back. In some embodiments: the seat comprises a pelvic nest for cradling the ischial tuberosities of the user, a thigh pad engaging the user's posterior thighs forward of the pelvic nest, and a thigh relief interconnecting the pelvic nest and the thigh pad for permitting compliant deflection of the thigh pad with respect to the pelvic nest; and the upper chair further comprises a back extending up with respect to the seat and including an upper portion and a lower portion, the upper and lower portions being pivotable with respect to each other. In some embodiments, the pelvic nest positions the user's ischial tuberosities below the upper chair pivot axis. In some embodiments, the upper chair pivots about the upper chair pivot axis to maintain the pelvic nest in a consistent attitude with respect to the user's ischial tuberosities through a range of tilting motion of the tilt-swivel mechanism, such that the user's ischial tuberosities are maintained in the pelvic nest through the range of motion. In some embodiments, the thigh pad has a 35° range of pivotable motion with respect to the pelvic nest. In some embodiments, the thigh relief distributes and reduces pressures on portions of the user's posterior thighs positioned over the thigh relief. In some embodiments, an ingress condition of the chair comprises the thigh pad being pivoted downward with respect to the pelvic nest and the back being pivoted rearward with respect to the pelvic nest; and an engaged condition of the chair comprises the thigh pad being pivoted upward with respect to the pelvic nest and the lower portion of the back being pivoted forward with respect to the pelvic nest. In some embodiments, when the chair is in the engaged condition the thigh pad applies dynamic pressure on the user's posterior thighs to activate muscles in the user's thighs and thereby assist the user to naturally leverage and balance a torso, spine, and pelvis of the user in a neutral posture. In some embodiments, when the chair is in the engaged condition the lower portion of the back engages the user's lumbar spine and sacrum to resist posterior rotation of the user's pelvis. In some embodiments, the invention further comprises a thigh return spring biasing the thigh pad into the ingress position and a sacral return spring biasing the lower back support into the ingress position. In some embodiments, the lower portion of the back is pivotably and slidably mounted to the lower back support about a sliding lower back pivot axis; and pivotal movement of the lower back support member applies a linear force on the lower portion of the back perpendicular to the sacral sliding pivot axis to move the lower portion of the back between the ingress position and engaged position. In some embodiments, the sacral sliding pivot axis is horizontal and coincident to a center of pressure applied to the lower portion of the back by the user such that the lower portion of the back is free to pivot about the sacral sliding pivot axis to orient the lower portion of the back to an angle of the user's lumbar spine and sacrum. In some embodiments, the invention further comprises a pulley mounted under the pelvic nest, a nesting cable interconnected at opposite ends to the thigh pad and the lower back support, the nesting cable extending over the pulley such that downward force on the pelvic nest arising from the user sitting in the pelvic nest generates tension in the nesting cable to pivot each of the thigh pad and the lower back support into the engaged condition. In some embodiments: the lower back support pivots about a posterior pivot axis below and rearward of the upper chair pivot axis; the lower back support includes a lower back cam surface through which the posterior pivot axis extends; a first end of the nesting cable is connected to the lower back support; and the nesting cable engages the lower back cam surface such that tension in the nesting cable generates a moment on the lower back support about the posterior pivot axis to move the lower portion of the back into the engaged position. In some embodiments, the lower back support has a 21° range of pivotable motion with respect to the posterior pivot axis. In some embodiments, the upper chair includes a body support frame pivotably mounted to the yoke about the upper chair pivot axis, the body support frame extending below the seat and behind the back, the seat being supported by the body support frame, the upper portion of the back pivoting with respect to the body support frame about the thoracic pivot axis. In some embodiments, the invention further comprises a thigh support pivotably interconnected to the body support frame about a horizontal hip pivot axis that is below and forward of the upper chair pivot axis, the thigh pad being interconnected with the thigh support via a thigh pad sliding pivot axis under the thigh pad to enable relative rotation and translation between the thigh pad and thigh support. In some embodiments: the thigh support includes a hip cam surface that is eccentrically positioned on the hip pivot axis; a second end of the nesting cable connects to the thigh support; and the nesting cable engages the hip cam surface such that tension in the nesting cable generates a moment on the thigh support about the hip pivot axis to move the thigh pad into the engaged position. In some embodiments, the invention further comprises at least one travel stop for limiting the total rotation of the of the body support frame with respect to the yoke about the upper chair pivot axis to a total range of 12°.

In another aspect, the invention provides a lower chair for supporting an upper chair on which a user sits, the lower chair comprising: a base; a swivel mechanism supported by the base, defining a vertical swivel axis; a four-bar assembly mounted to the swivel mechanism for rotation about the swivel axis, the four-bar assembly including a coupler link that moves about a coupler curve; a column having a lower end affixed to the coupler link for movement of the lower end along the coupler curve, the column defining a column axis and adapted to support the upper chair.

In some embodiments, the invention further comprises a yoke mounted to an upper end of the column opposite the lower end, the yoke adapted for interconnection to the upper chair for relatively pivotal movement of the upper chair with respect to the yoke about a horizontal upper chair pivot axis. In some embodiments, the upper chair pivot axis is the sole pivotal interconnection between the upper chair and lower chair. In some embodiments, the column defines a longitudinal axis angled with respect to the swivel axis and intersecting the swivel axis. In some embodiments, the lower end of the column is affixed to the coupler link to prevent rotation of the column about the longitudinal axis with respect to the coupler link. In some embodiments, the a range of motion of the four-bar linkage is limited by stops to limit a range of motion of the coupler link along the coupler curve. In some embodiments, motion of the lower end of the column along the coupler curve effects tilting of the column within a tilting range of motion limited to between 80-90° with respect to horizontal. In some embodiments, motion of the lower end of the column along the coupler curve effects tilting of the column within a tilting range of motion limited to between 82-87° with respect to horizontal. In some embodiments, rotation of the tilt mechanism on the swivel mechanism permits 360° of column swivel about the swivel axis. In some embodiments, the invention further comprises a dampener in the four-bar linkage for controlling a rate of movement of the column along the coupler curve. In some embodiments, the invention further comprises casters supporting the base above a floor, the casters enabling rolling motion of the lower chair on the floor. In some embodiments, the invention further comprises a biasing mechanism for moving the four-bar linkage into an at-rest position the upper chair is not occupied.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The present invention relates to a chair having multiple pivot axes for accommodating the natural movements of the user's body, while maintaining the user in an active, engaged, "ready" posture. To avoid crowding the drawings with reference numbers for different ends, sides, etc. of parts of the chair, it will be presumed that one of ordinary skill will read this disclosure with the ordinary meaning of directional and positional terms in mind. Throughout this disclosure, for example, the terms "left," "right," "rear," and "front" are used from the perspective of an occupant or user seated in the chair. Terms such as "top" and "bottom" are used with respect to the intended ordinary condition of the chair. The term "above" means that one component is positioned higher than another with necessarily being in the same vertical plane. The term "vertically above" means that one component is higher than another thing and in the same vertical plane. "Below" means a component is lower than another component, whereas "vertically below" means that the component is lower and also within the same vertical plane as the other component.

Figure 1:
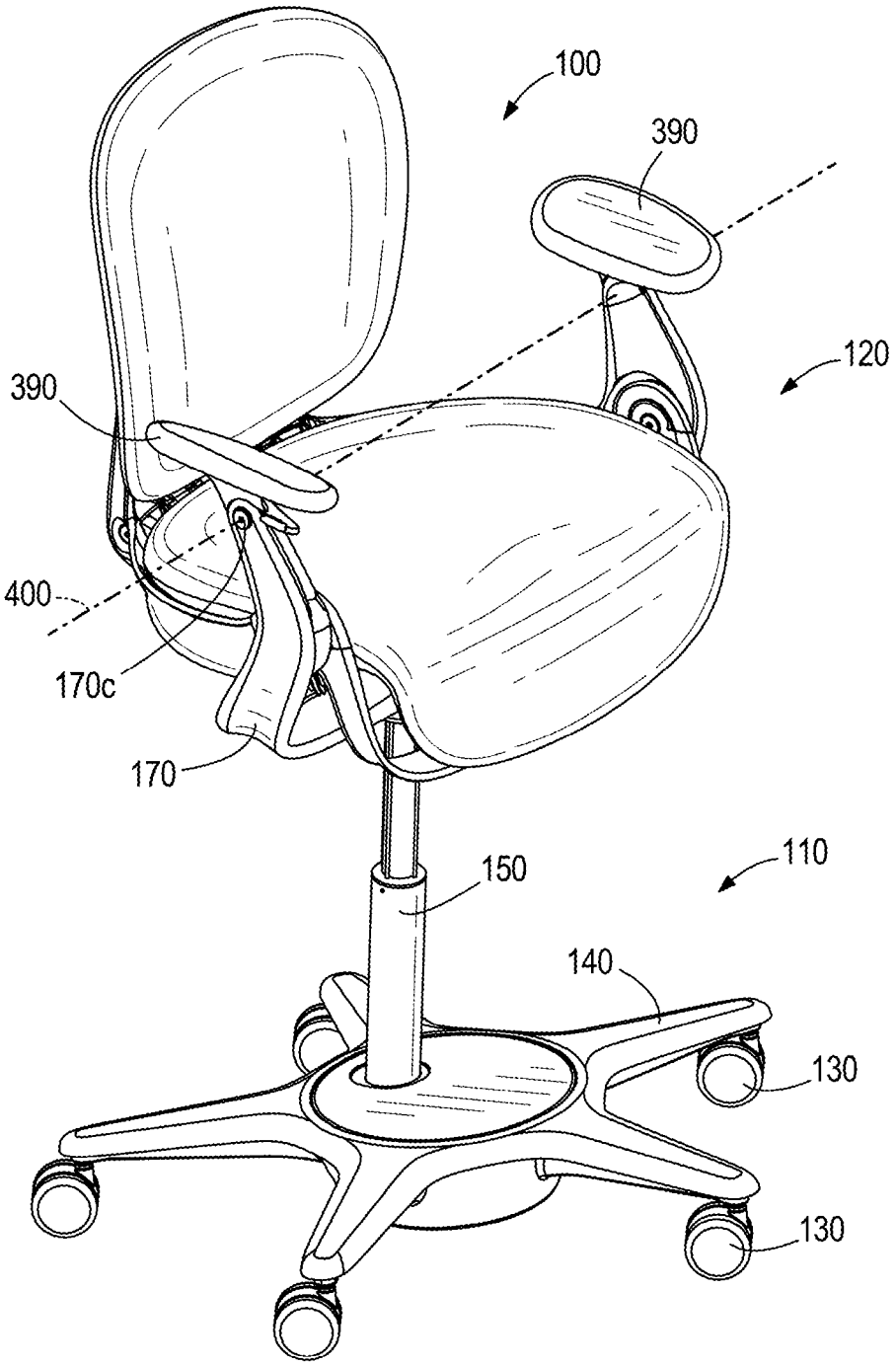
FIG. 1 is a perspective view of a chair according to one embodiment of the present invention.
Figure 2:
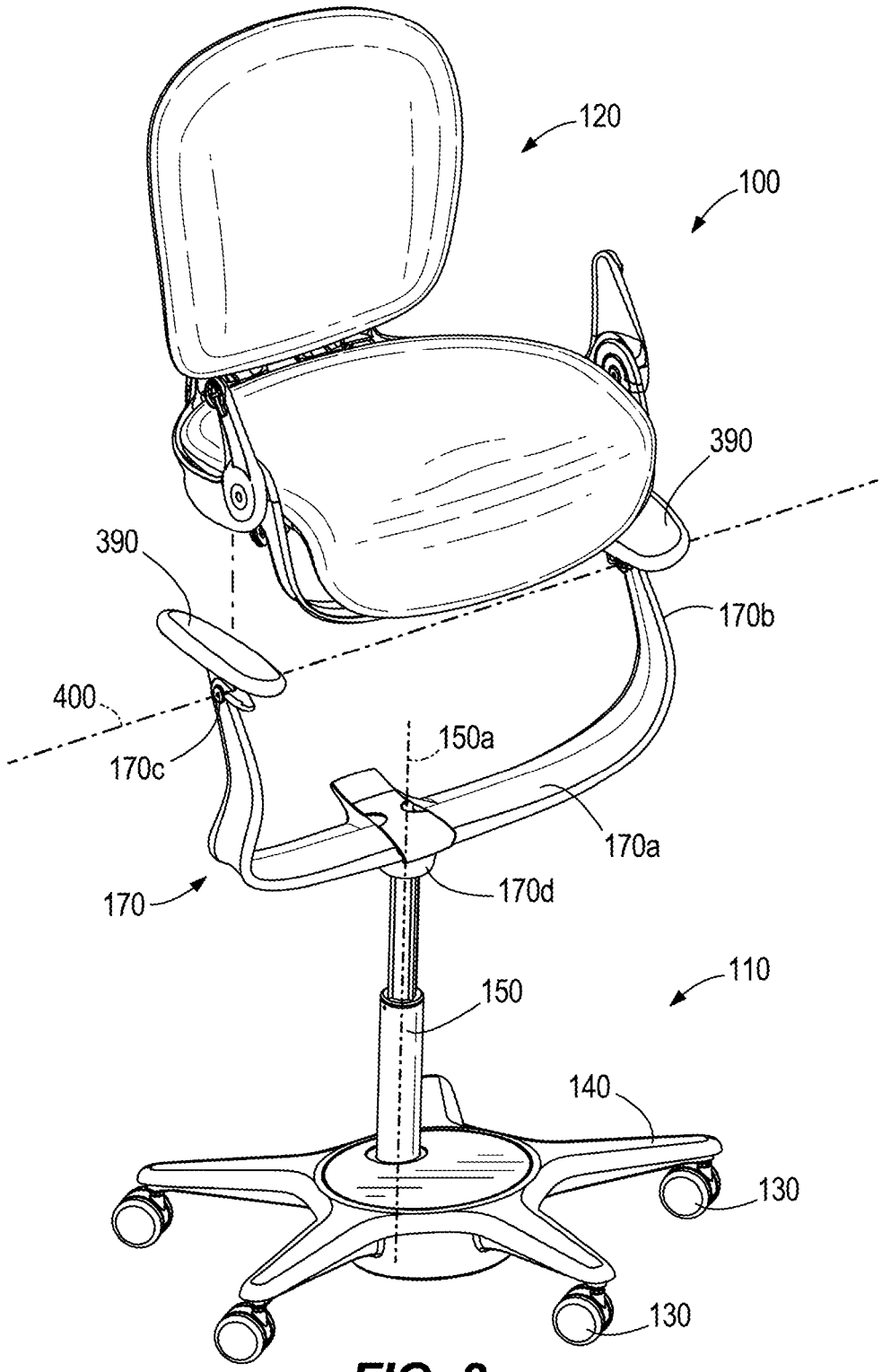
FIG. 2 is a partially-exploded view of the chair.

FIGS. 1 and 2 illustrate a chair 100, the main subassemblies of which are a lower chair 110 and an upper chair 120. FIG. 1 illustrates the chair 100 in an ingress/egress or "at-rest" condition or position, which it assumes when there is no user. The chair 100 has various biasing members which bias its components into the ingress condition or position, as will be explained below. The ingress position of the chair 100 facilitates a user getting into and out of the chair, as will be further explained below. Unless stated otherwise, an "ingress" condition or position of any component of the chair 100 is the condition or position of that component when the chair 100 is in the ingress position in FIG. 1.

Figure 21:
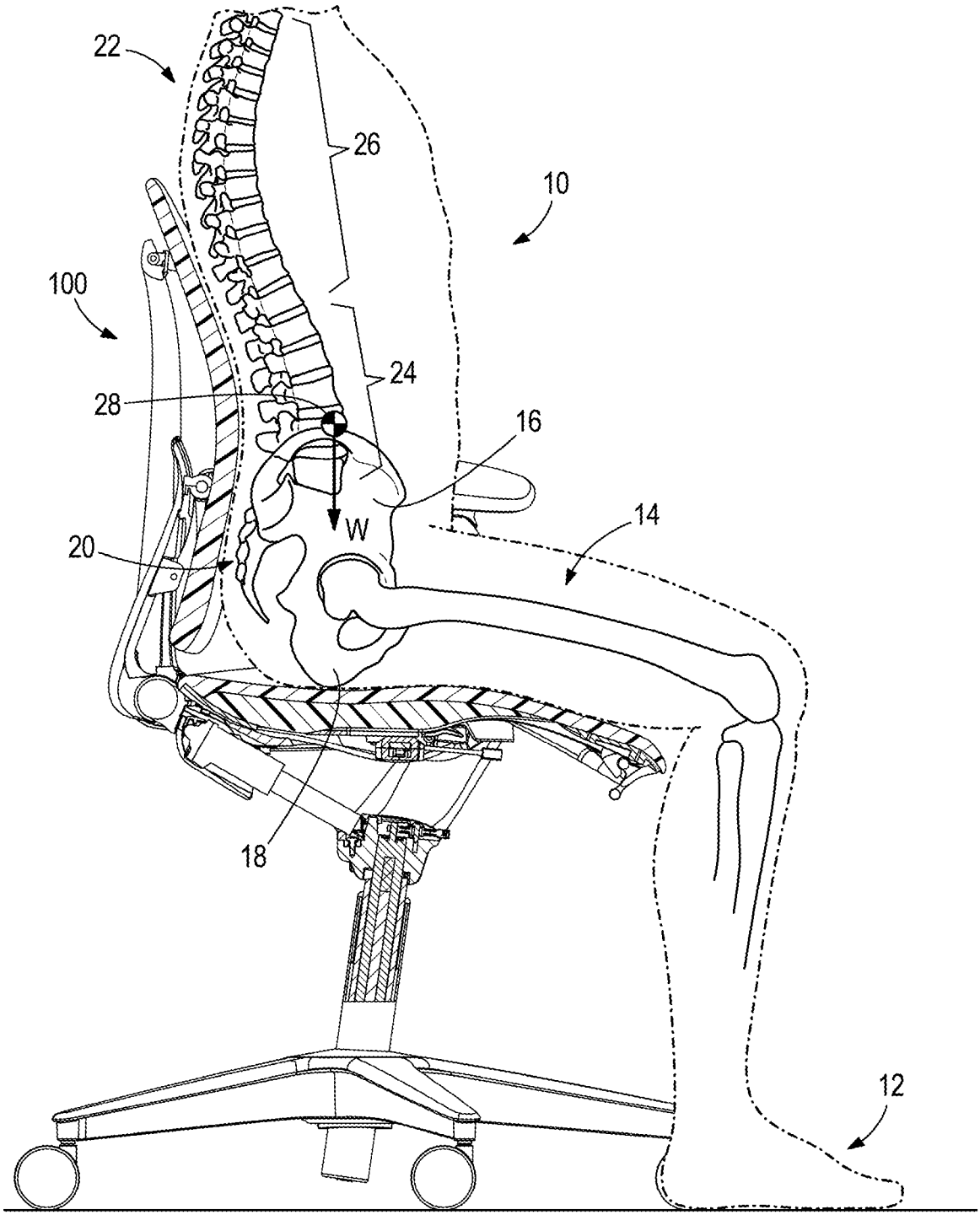
FIG. 21 is a side view of a user seated on the seat.

For parts and regions of the user's body, reference is made to FIG. 21 which includes a version of the chair 100 with a user 10 represented by the user's skeleton. No unusual definitions for anatomical parts are intended for this disclosure and additional reference can be had to commonly-accepted medical authorities. The user's 10 body includes feet 12, thighs 14, pelvis 16, ischial tuberosities 18, sacrum 20, and spine 22. The spine 22 includes a lumbar region 24 (L1-L5 vertebrae) and a thoracic region 26 (T1-T12 vertebrae). The "lower back" of the user 10 is the lumbar region 24 and sacrum 20 and the "upper back" is the thoracic region 26. The "torso" includes the central part of the user 10 built on the pelvis 16 and spine 22. The torso includes what is commonly called the user's core. The user's center of mass 28 is approximated in the drawing and the user's weight W is modeled as a downward force acting through the center of mass 28. The term "posterior" as it may be used in the following description is used consistently with commonly-accepted definitions of the term, simply referring to a rear part of the body part being described. The term "inferior" likewise means a body part or portion that is below or lower than a reference body part or portion.

Lower Chair

With continued reference to FIGS. 1 and 2, the lower chair 110 provides support structure, tilting motion, swivel motion, rolling motion, height adjustment and stability that functions with the user's body. The main components and subassemblies of the lower chair 110 are a plurality of casters 130, a base 140, a height-adjustable column 150, a tilt-swivel mechanism 160 (FIGS. 3-8), and a yoke 170.

Figure 3:
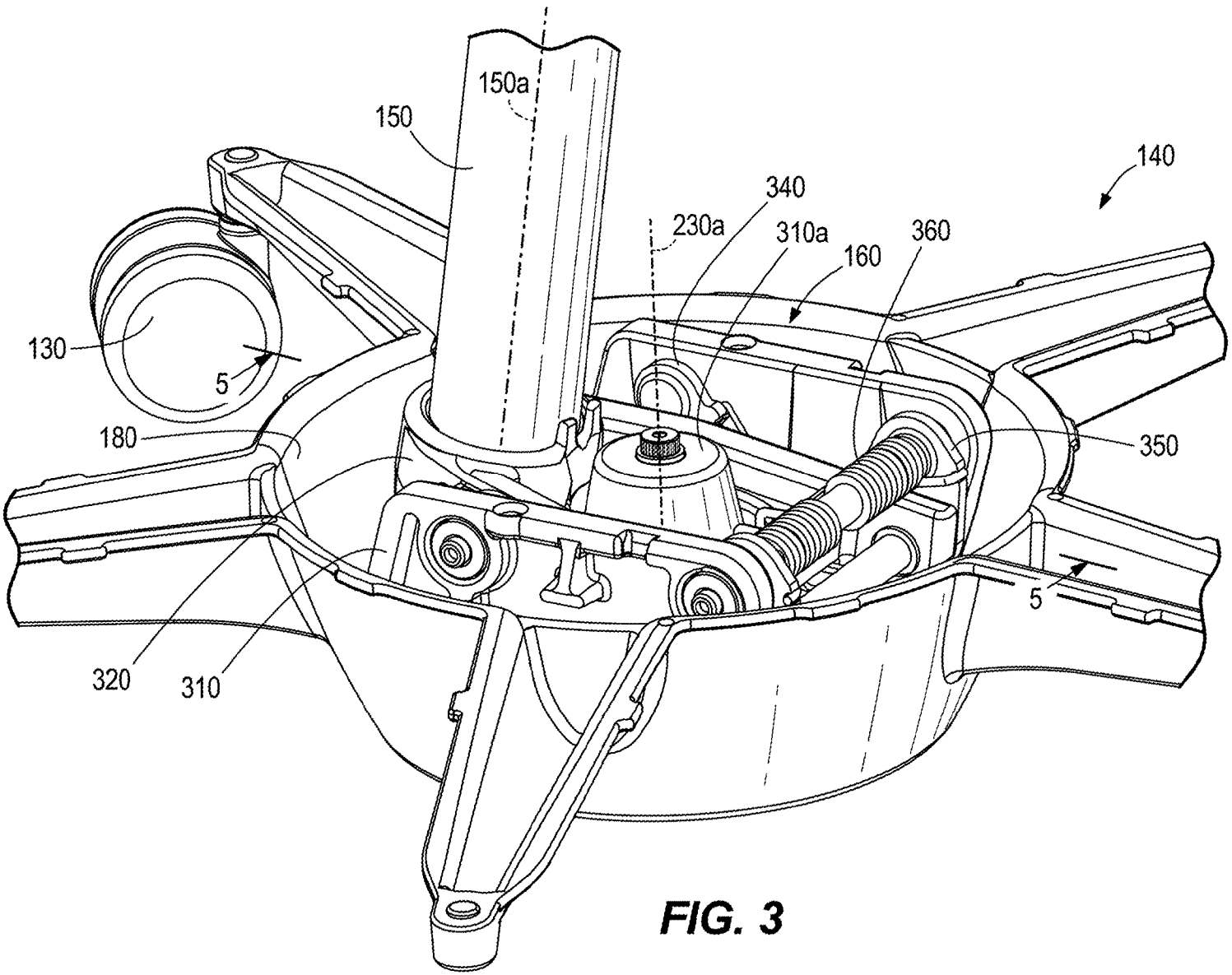
FIG. 3 is a perspective view of a base portion of the chair.

The casters 130 provide rolling motion in the horizontal plane of the floor. Referring to FIG. 3, the base 140 is supported by the casters 130 and includes a cavity 180 that houses the tilt-swivel mechanism 160. As see in FIG. 2, the height-adjustable column 150 column extends between the tilt-swivel mechanism 160 (contained in the base 140) and the yoke 170. The height-adjustable column 150 defines a longitudinal axis 150*a* which may also be referred to as the support axis of the chair 100. The bottom end of the height-adjustable column 150 is supported by the tilt-swivel mechanism 160 while the top end supports the yoke 170. The height-adjustable column 150 is of the telescoping variety (e.g., with a plurality of sections telescopically arranged) such that it can be lengthened or shortened along the longitudinal axis 150*a*. The height-adjustable column 150 is well-known in the art and a specific commercially-available height-adjustable column 150 can be selected depending on the performance characteristics of the chair 100. Preferably, the height-adjustable column 150 has a range of heights (i.e., the distance between the bottom and top ends along the longitudinal axis 150*a*) of ten inches to accommodate a wide variety of users in a wide variety of positions between seat heights of twenty-three inches to thirty-three inches between floor and upper pivot axis 400.

Figure 4:
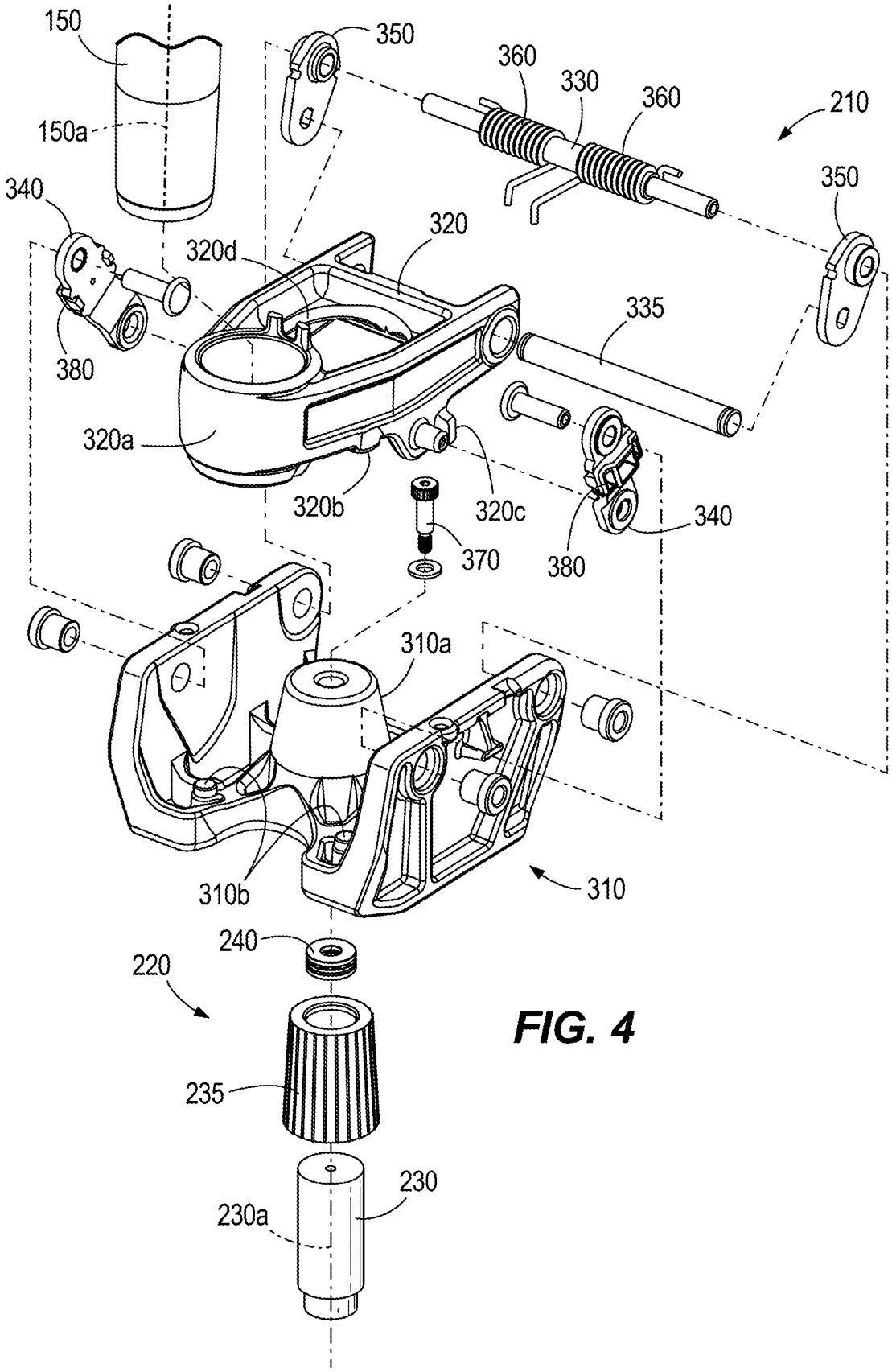
FIG. 4 is an exploded view of a tilt-swivel mechanism in the base of the chair.
Figure 5:
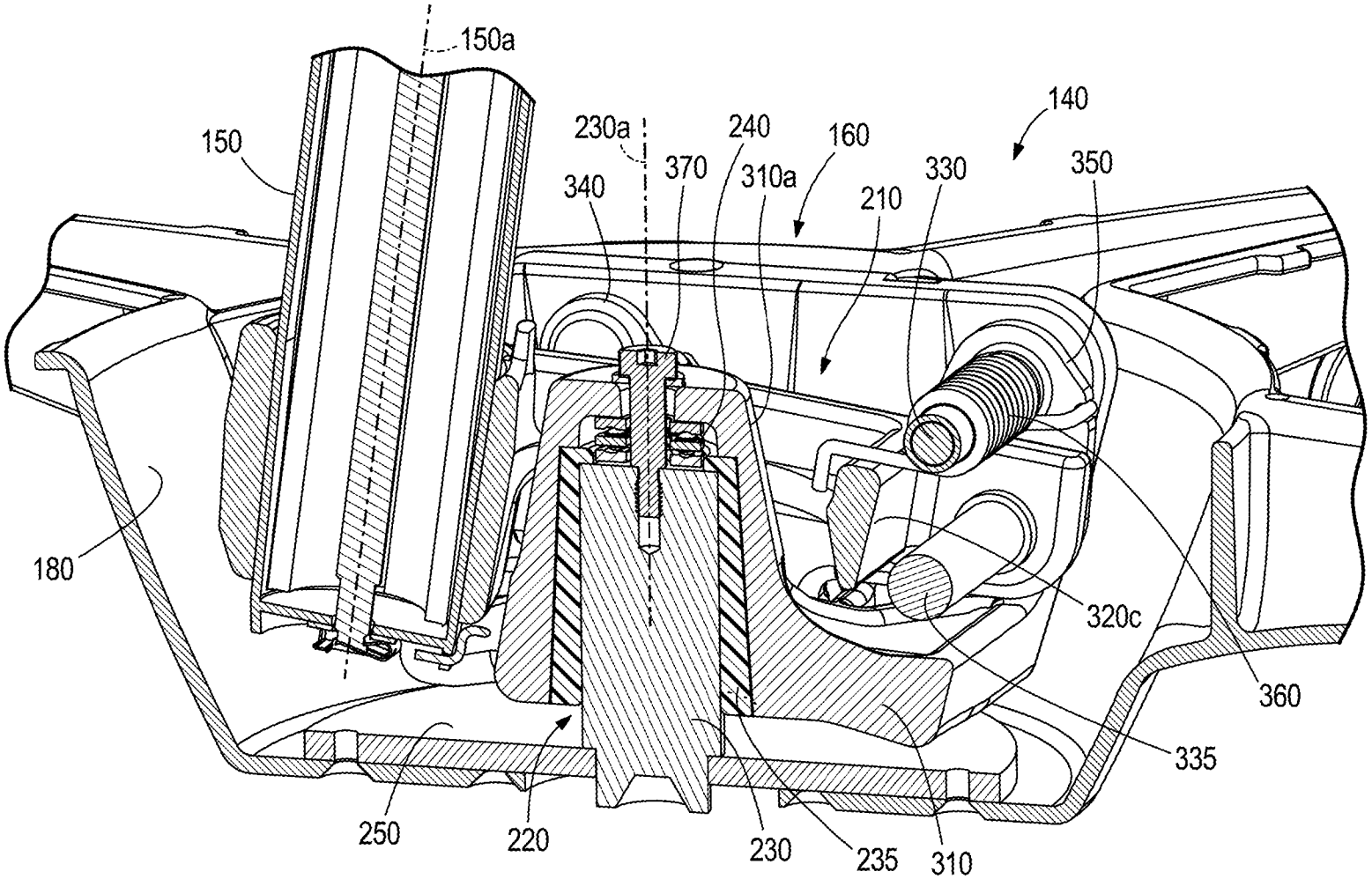
FIG. 5 cross-sectional view of the base portion taken along line 5-5 in FIG. 3.

The tilt-swivel mechanism 160 is illustrated in FIGS. 3-8. As seen in FIGS. 4 and 5, the tilt-swivel mechanism 160 includes a tilt mechanism 210 and a swivel mechanism 220. The swivel mechanism 220 comprises a vertical swivel shaft 230, a sleeve bearing 235, and a thrust bearing 240. The swivel shaft 230 defines a vertical swivel axis 230*a*. As seen in FIG. 5, the bottom end of the swivel shaft 230 is mounted to a mounting plate 250 which is secured to the bottom of the cavity 180 of the base 140, such that the swivel shaft 230 and swivel axis 230*a* are fixed and centered with respect to the base 140. Through the sleeve bearing 235 and thrust bearing 240, the tilt mechanism 210 rotates inside the cavity 180 on the swivel shaft 230 about the swivel axis 230*a* as will be explained below.

Referring again to FIG. 4, the tilt mechanism 210 includes a ground frame 310, a coupler member 320, an upper pivot crossbar 330, a lower pivot crossbar 335, a pair of rear links 340 (i.e., left and right), a pair of front links 350 (i.e., left and right), and a pair of return springs 360. The ground frame 310 is generally U-shaped and includes a horizontal bottom and two vertical sides.

Figure 6:
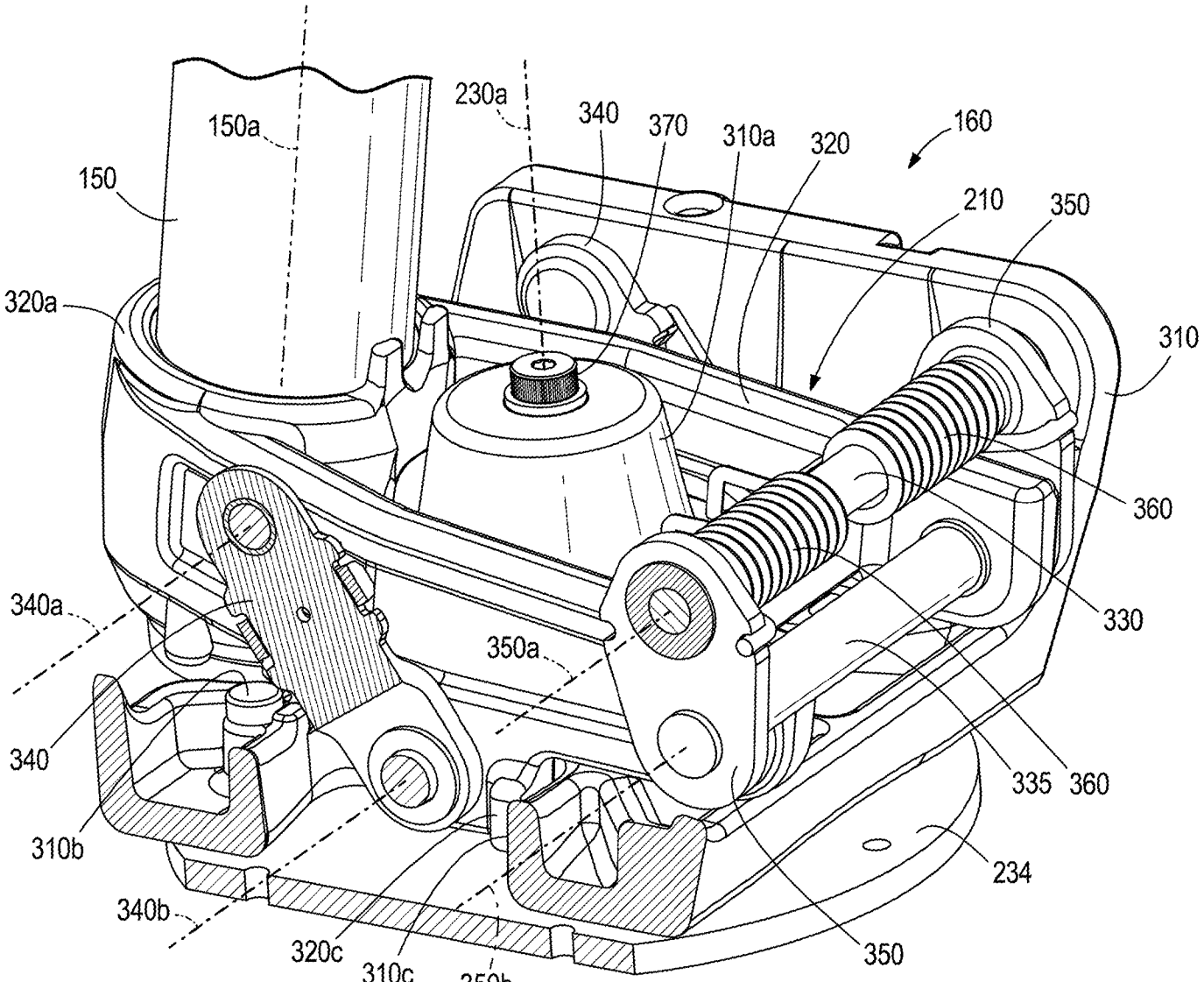
FIG. 6 is a perspective, cross-sectional view of the tilt-swivel mechanism in a full-forward position.
Figure 7:
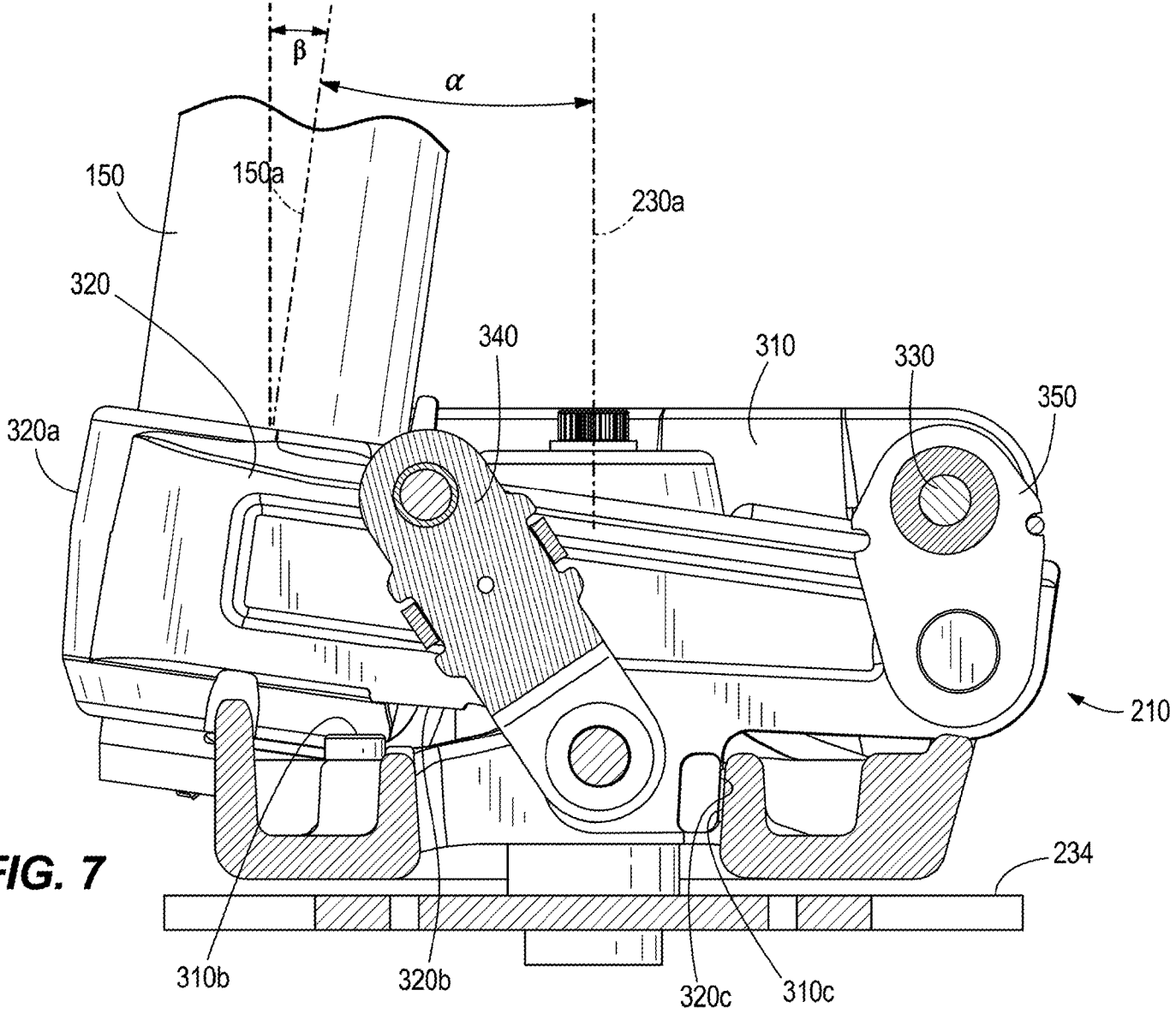
FIG. 7 is a side view of FIG. 6.

Referring now to FIG. 5, the bottom of the ground frame 310 includes a ground hub 310*a* defining a bore into which the swivel shaft 230, sleeve bearing 235, and thrust bearing 240 are received. The sleeve bearing 235 is pressed into the bore of the ground hub 310*a* and the thrust bearing 240 sits on top of the sleeve bearing 235 to support a downward-facing shoulder of the ground hub 310*a*. A bolt 370 threads into the top of the swivel shaft 230 to secure the ground frame 310 to the swivel shaft 230. With this arrangement, the swivel mechanism 220 supports the entire tilt mechanism 210 through the ground frame 310. As seen in FIGS. 4, 6 and 7, the ground frame 310 also includes a pair (i.e., left and right) of upwardly-facing rear stops 310*b* and a pair (i.e., left and right) of rearwardly-facing front stops 310*c* that constrain the range of motion of the coupler member 320 with respect to the ground frame 310, as will be described below.

Referring back to FIGS. 4 and 5, the coupler member 320 fits between the vertical sides of the ground frame 310, and can be said to "nest" in the ground frame 310 to lower the profile of the overall tilt mechanism 210. The coupler member 320 includes a coupler hub 320*a* that receives the bottom end of the height-adjustable column 150. The height-adjustable column 150 is locked by the coupler hub 320*a* against rotation about the longitudinal axis 150*a*. In its ordinary operating positions, the coupler hub 320*a* is angled such that the longitudinal axis 150*a* extends at a non-vertical angle. The coupler member 320 includes a pair (i.e., left and right) of downwardly-facing rear stops 320*b* and a pair (i.e., left and right) of forwardly-facing front stops 320*c* that constrain the range of motion of the coupler member 320 with respect to the ground frame 310, as will be described below.

The coupler member 320 also includes a clearance space 320*d* (FIG. 4) through which the ground hub 310*a* extends. The clearance space 320*d* permits the coupler member 320 to be positioned low in the ground frame 310 with the ground hub 310*a* extending up through the clearance space 320*d*, thereby contributing to the low profile of the tilt mechanism 210. The clearance space 320*d* permits the coupler member 320 to move through its entire range of motion (constrained by abutment of the rear stops 310*b*, 320*b* and front stops 310*c*, 320*c*) without abutting the ground hub 310*a*, as will be discussed below.

The upper pivot crossbar 330 is mounted at opposite ends to the vertical sides of the ground frame 310. The lower pivot cross bar 335 is mounted at opposite ends to the front end of the coupler member 320. With reference to FIG. 6, each rear link 340 is pivotably mounted at an upper end to one of the vertical side walls of the ground flange 310 for pivoting about an upper rear pivot axis 340*a*, and is pivotably mounted at a lower end to the coupler member 320 for pivoting about a lower rear pivot axis 340*b*. Each front link 350 is pivotably mounted at an upper end to the upper pivot cross bar 330 for pivoting about an upper front pivot axis 350*a*, and is pivotably mounted at a lower end to the lower pivot crossbar 335 for pivoting about a lower front pivot axis 350*b*.

The configuration results in the coupler member 320 hanging down inside (i.e., nested within) the ground frame 310 and swinging or gliding with respect to the ground frame 310. The return springs 360 are illustrated as torsion springs, each include a first end bearing against the coupler member 320 and a second end bearing against one of the front links 350. The second end of the return springs 360 may be received in a notch in the side of the front links 350. For convenience of manufacture and assembly, the front links 350 may be made with notches on both side so that the same part can be used on the right and left sides of the mechanism 160. The return springs 360 bias the tilt mechanism 210 into the full-forward position or ingress position, which will be described below. As seen in FIG. 4, the tilt mechanism 210 further includes dampening pads 380 that slide against the vertical walls of the ground frame 310 to generate friction which helps control the rate of tilting motion and increase user control.

It will be appreciated that the tilt mechanism 210 is a four-bar assembly or linkage. A four-bar assembly includes a ground link, a coupler link (sometimes called a floater link), and two additional links (often called an input link and an output link) that are pivotably connected to each of the ground link and coupler link. In the tilt mechanism 210, the ground frame 310 (or each of its left and right vertical sides) is analogous to the ground link, the coupler member 320 (or each of its left and right sides) is analogous to the coupler link, and the rear links 340 and front links 350 are analogous to the input and output links. It is not important for the purposes of the present invention whether the rear links 340 or front links 350 are considered analogous to the respective "input link" and "output link" of a model four-bar assembly. As noted above, the front and rear links 340, 350 are pivotably interconnected to the ground frame 310 and coupler member 320 about four parallel (horizontal) axes 340*a*, 340*b*, 350*a*, 350*b*, one axis at each end of the links 340, 350.

The constrained motion of the coupler member 320 with respect to the ground frame 310 will now be explained with reference to FIGS. 7 and 8. The rear stops 320*b* and front stops 320*c* of the coupler member 320 constrain respective rearward and forward movement of the tilt mechanism 210 by abutting the respective rear stop 310*b* and forward stop 310*c* of the ground frame 310. The full range of motion for the coupler member 320 is between the ingress or full-forward position illustrated in FIG. 7 and the full-rearward position illustrated in FIG. 8.

The constrained motion of the tilt mechanism 210 causes the coupler member 320 (and thus the height-adjustable column 150, yoke 170, and upper chair 120) to describe a coupler curve. The height-adjustable column 150 therefore moves about the coupler curve to change the angle of the longitudinal axis 150*a* with respect to vertical. The longitudinal axis 150*a* is disposed at an angle α with respect to the vertical swivel axis 230*a* and intersects the swivel axis 230*a*. The swivel axis 230*a* is offset from the longitudinal axis 150*a*. The swivel mechanism 220 permits the height-adjustable column 150 to orbit a full 360° about the swivel axis 230*a*.

Figure 8:
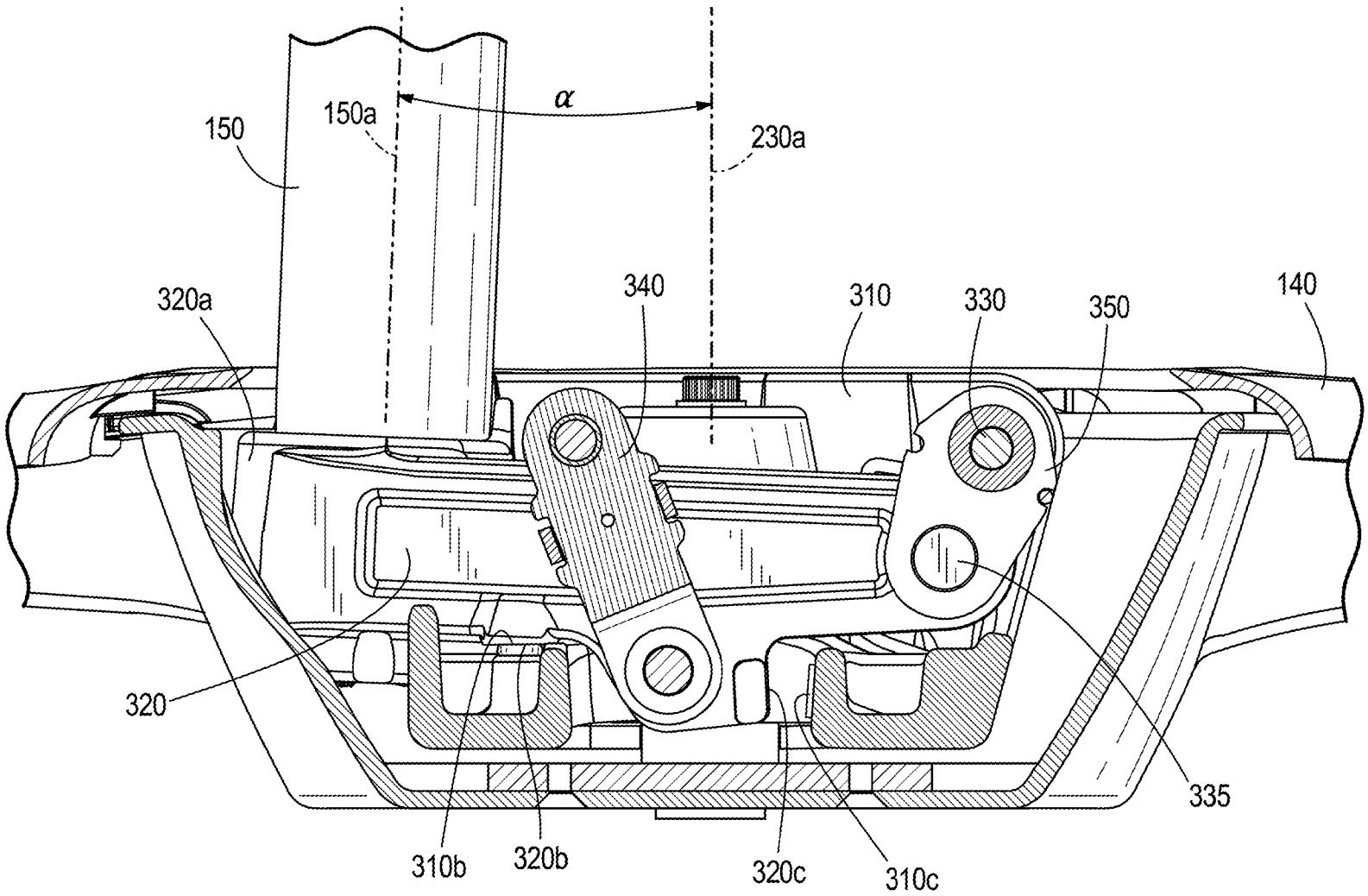
FIG. 8 is a side, cross-sectional view of the tilt-swivel mechanism in a full-rearward position.

FIGS. 6-8 illustrate an angle of tilt α, which is the angle between the longitudinal axis 150*a* and a vertical line. The angle of tilt α is the supplemental angle to the angle β between the longitudinal axis 150*a* and the vertical swivel axis 230*a*. The angle of tilt α in the ingress condition (FIGS. 6 and 7) may be 13°-20° depending on the setup of the chair. The angle of tilt α in the full-rearward position (FIG. 8) may be 0°-10° (where 0° means that the longitudinal axis 150*a* is vertical). Consequently, the full range of motion of the longitudinal axis 150*a* (i.e., the range of angle of tilt α) can be as high as 20° and as low as 3°. In some embodiments, the range of the angle of tilt α can be any range between 3°-20°, including but not limited to 6°, 8°, 10°, 12°, 14°, 16° and 18°.

In the illustrated embodiment and in other preferred embodiments, the longitudinal axis 150*a* is prevented from being vertical (i.e., the setup is such that the angle of tilt α is prevented from being 0°). Preventing a vertical longitudinal axis 150*a* causes the user to always have an engaged core and activates other muscle groups in addition to bearing a significant portion of the user's weight on the user's feet, as will be described below in the user interaction section of this disclosure.

Referring now to FIG. 2, the yoke 170 is a rigid support structure with an upwardly-opening "U" shape defined by a base 170*a* and left and right uprights 170*b* extending up from the base 170*a*. The free ends of the uprights 170*b* support generally horizontal arm rests 390 for the chair user.

As will be explained in more detail below, the upper chair 120 is mounted to the free ends of the uprights 170*b* for pivoting about a horizontal upper chair pivot axis 400. The upper chair pivot axis 400 is the sole pivotal interconnection between the upper chair 120 and the lower chair 110. Because the arm rests 390 are mounted to the uprights 170*b*, they remain stationary with respect to the yoke 170 as the upper chair 120 pivots about the upper chair pivot axis 400. The yoke 170 also has a downwardly-open taper joint 170*d* at the bottom center of the base 170*a*. The taper joint 170*d* receives the top end of the height-adjustable column 150. The uprights 170*b* are equally spaced from taper joint 170*d*.

It will be appreciated in view of the above description, in combination with the following description of the upper chair 120, that the tilt-swivel mechanism 160 provides tilting motion of the lower chair 110 in a prescribed fore-aft coupler motion that maintains the seated user on a relatively level horizontal plane without dumping the user out of the upper chair 120.

This offset further allows the height-adjustable column 150 to tilt toward and away from the central swivel axis 230*a* from a position off-center with respect to the base 140 to maintain the user's center of mass over the base 140 and casters 130 through the full range of tilting and swiveling motion and through the full range of the height-adjustable column 150. Consequently, the user can move in any swivel position and tilting position without tipping over or the chair sliding away from the user.

The height-adjustable column 150 provides a range of seat heights that accommodates the 5th to 95th percentile user sizes in both active and offloaded sitting postures. The seated height range is controlled when the user activates the height-adjustable column 150 via a control lever. The adjustable seat height range allows a user to sit in multiple tilted and swiveled positions with a thigh-to-torso angle γ (FIGS. 15-16) ranging from 90° to 130°. In some embodiments, the range of thigh-to-torso angles allowed by the adjustable seat height range can be 100°-130°, 100°-120°, or any other range of thigh-to-torso angles within the range 90° to 130°.

It should be appreciated that in other configurations or embodiments of the invention, the tilt mechanism 210 and/or the swivel mechanism 220 can be removed from the base 140. For example, the tilt mechanism 210 could be removed such that the base of the height-adjustable column 150 is mounted directly to the swivel mechanism 220. Likewise, the swivel mechanism 220 could be removed such that the tilt mechanism 210 is directly mounted to the base 140. Last, both the tilt mechanism 210 and swivel mechanism 220 could both be removed such that the base of the height-adjustable column 150 is mounted directly to the base 140 of the chair 100. In embodiments where the tilt mechanism 210 is removed, the height-adjustable column 150 may be set at fixed angle of tilt α within the ranges described in this disclosure. In other embodiments, a locking mechanism may be added to the tilt mechanism 210 to lock the tilt mechanism 210 at a desired angle of tilt α within the ranges described in this disclosure. The locking mechanism can be unlocked to adjust the angle of tilt α, and then reengaged to lock the tilt mechanism 210 at a new angle of tilt α. Alternatively, the locking mechanism may remain unlocked to permit free tilting if desired by the user.

Upper Chair

Figure 9:
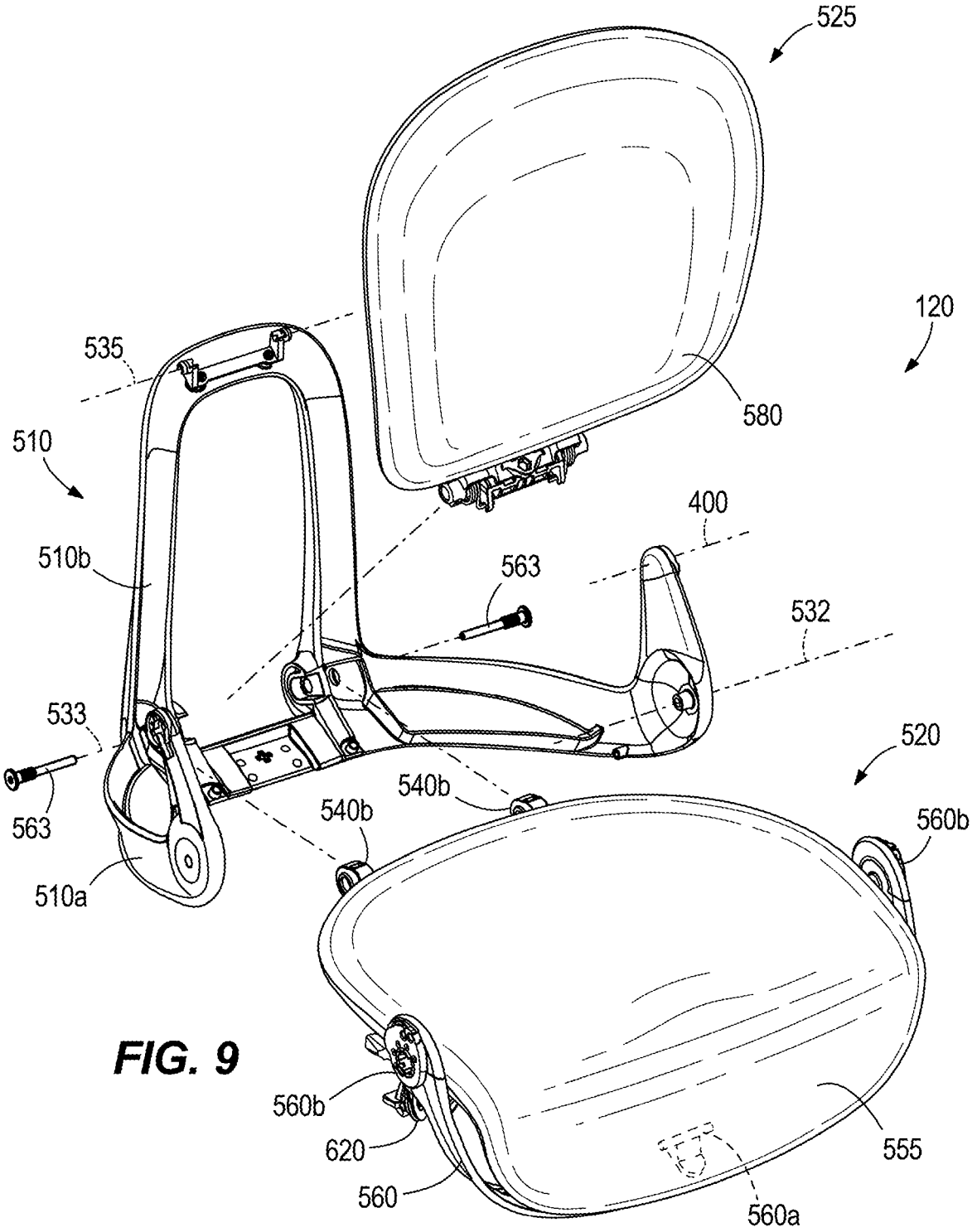
FIG. 9 is an exploded view of the upper chair from a first perspective.
Figure 10:
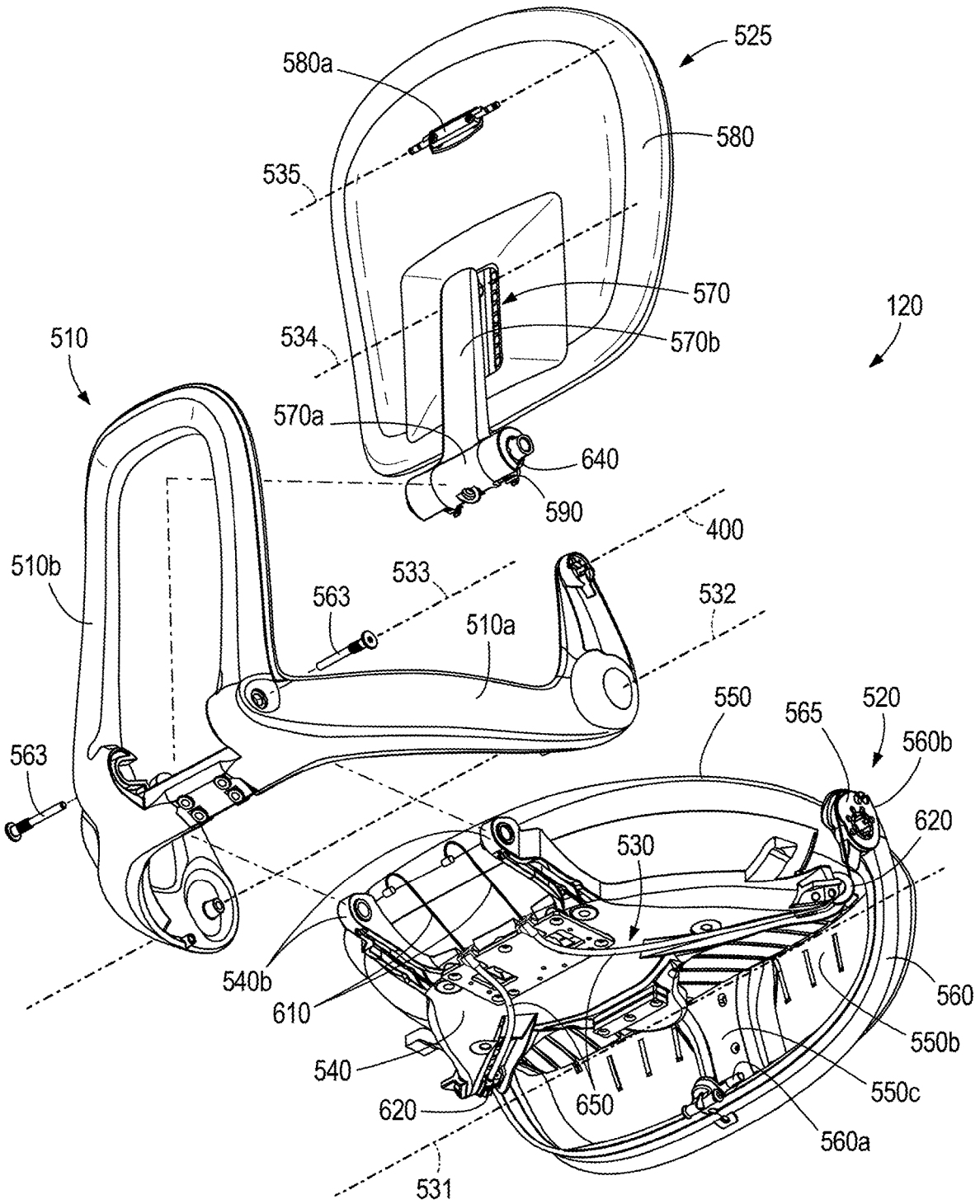
FIG. 10 is an exploded view of the upper chair from a second perspective.

Referring to FIGS. 9 and 10, the major subassemblies of the upper chair 120 are a body support frame 510, a seat assembly 520, a back assembly 525, and a nest actuator assembly 530. The upper chair 120 provides (a) pelvic/sacrum/lumbar support structure and dynamics, (b) thoracic spine support structure and dynamics, (c) thigh support structure and dynamics, and (d) body support frame and dynamics. The term "lower back" will be used to describe the sacrum/lumbar region of the user (i.e., the sacrum and L1-L5 vertebrae) and the term "upper back" will be used to describe the thoracic region of the user (i.e., the T1-T12 vertebrae).

The body support frame 510 includes a generally horizontal seat portion 510*a* and a generally vertical back portion 510*b*. The horizontal seat portion 510*a* extends along the left and right sides of the upper chair 120 and the vertical back portion 510*b* is centered and at the rear of the upper chair 120. The vertical back portion 510*b* includes an upper pivot mount 510*c* which forms part of an upper pivot assembly that defines a thoracic pivot axis 535. The body support frame 510 is integrally formed as a single unit and is generally rigid. The body support frame 510 supports the user and controls the dynamic functions of the upper chair 120.

A SI pivot resistance applies a biasing moment to the body support frame 510 to control the rotation force about the upper chair pivot axis 400. The SI pivot damping controls the rotation rate about the upper chair pivot axis 400 and increases the user's control of motion and position. The body support frame 510 travel stops limit the total rotation of the of the body support frame 510 relative the yoke 170 to a total range of 12°.

Figure 11:
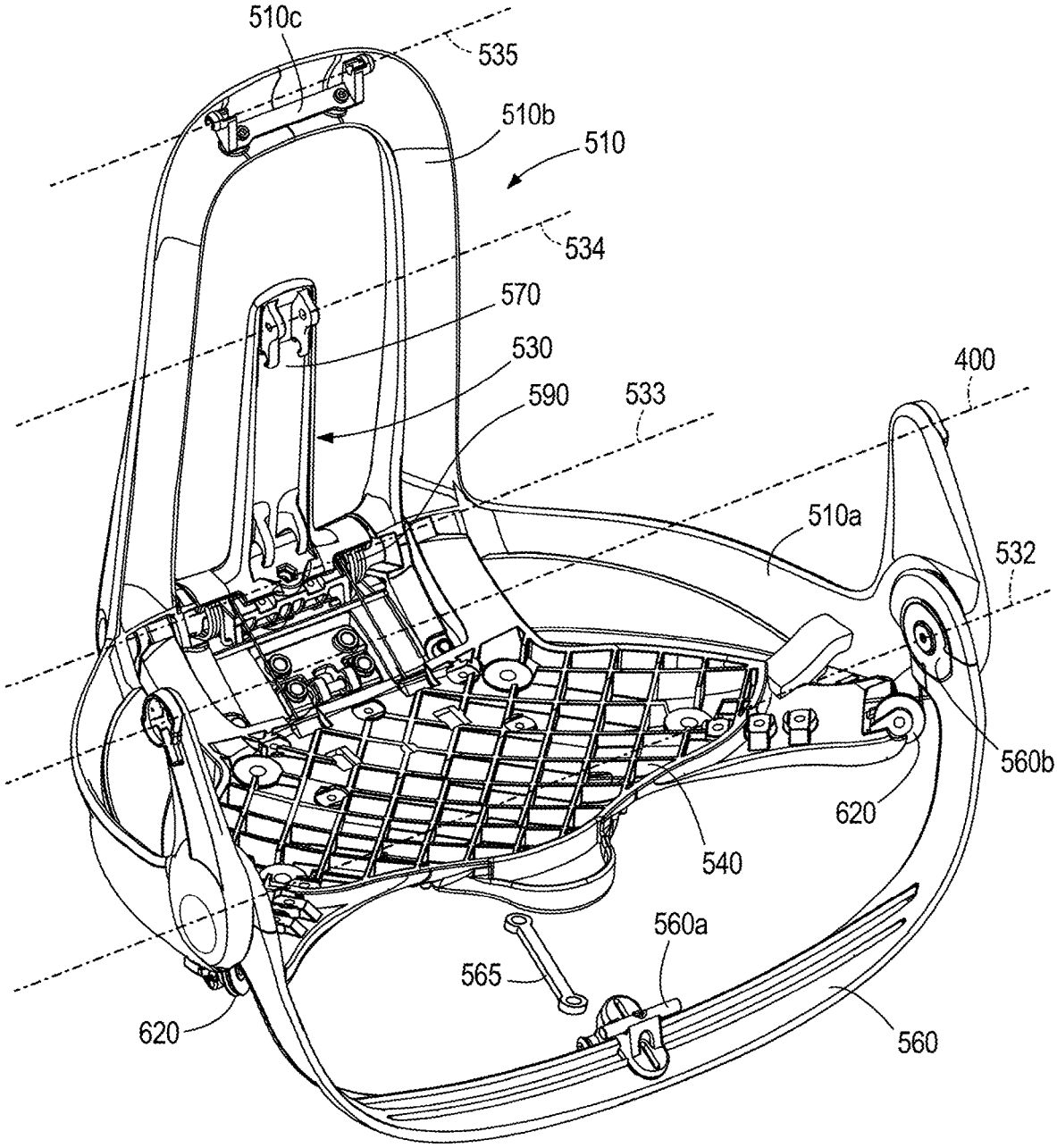
FIG. 11 is a perspective view of selected major components of the upper chair in an assembled condition.

Referring now to FIG. 11, the seat assembly 520 and the back assembly 525 are movably mounted to the body support frame 510, as will be described below, to maintain the user in the chair 100 through the full range of motion while permitting the user to assume a ready, engaged posture. The upper chair 120 includes multiple horizontal pivot axes where components are pivotably connected to each other. The horizontal pivot axes are: the upper chair pivot axis 400, a thigh relief bending beam which is modeled as a thigh relief axis 531 (FIGS. 12 and 13), a hip pivot axis 532, a posterior pivot axis 533, a lower back pivot axis 534, and the thoracic pivot axis 535 mentioned above. The pivot axes 400, 531, 532, 533, 534, 535 are positioned strategically to maximize comfort of a user and permit the user to engage muscles to remain in an active, engaged posture while using the chair 100. For example, the upper chair pivot axis 400 is located above the seat pan 540, above and rearward of the hip pivot axis 532, and forward of the vertical back portion 510*b*. The hip pivot axis 532 is forward of the users ischial tuberosities when the user is properly seated in the chair, as will be described below.

Figure 12:
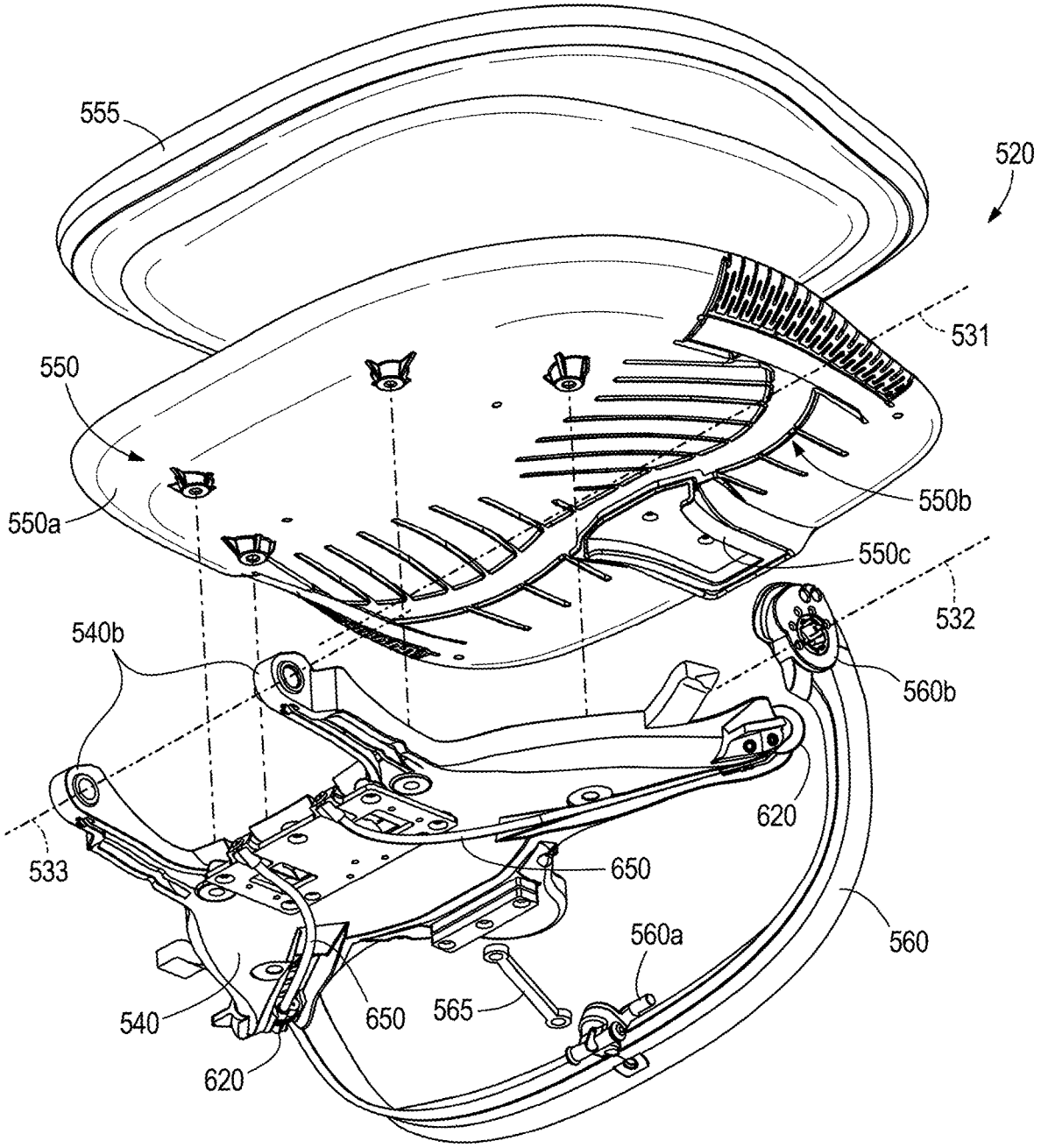
FIG. 12 is an exploded view of the seat assembly from a first perspective.
Figure 13:
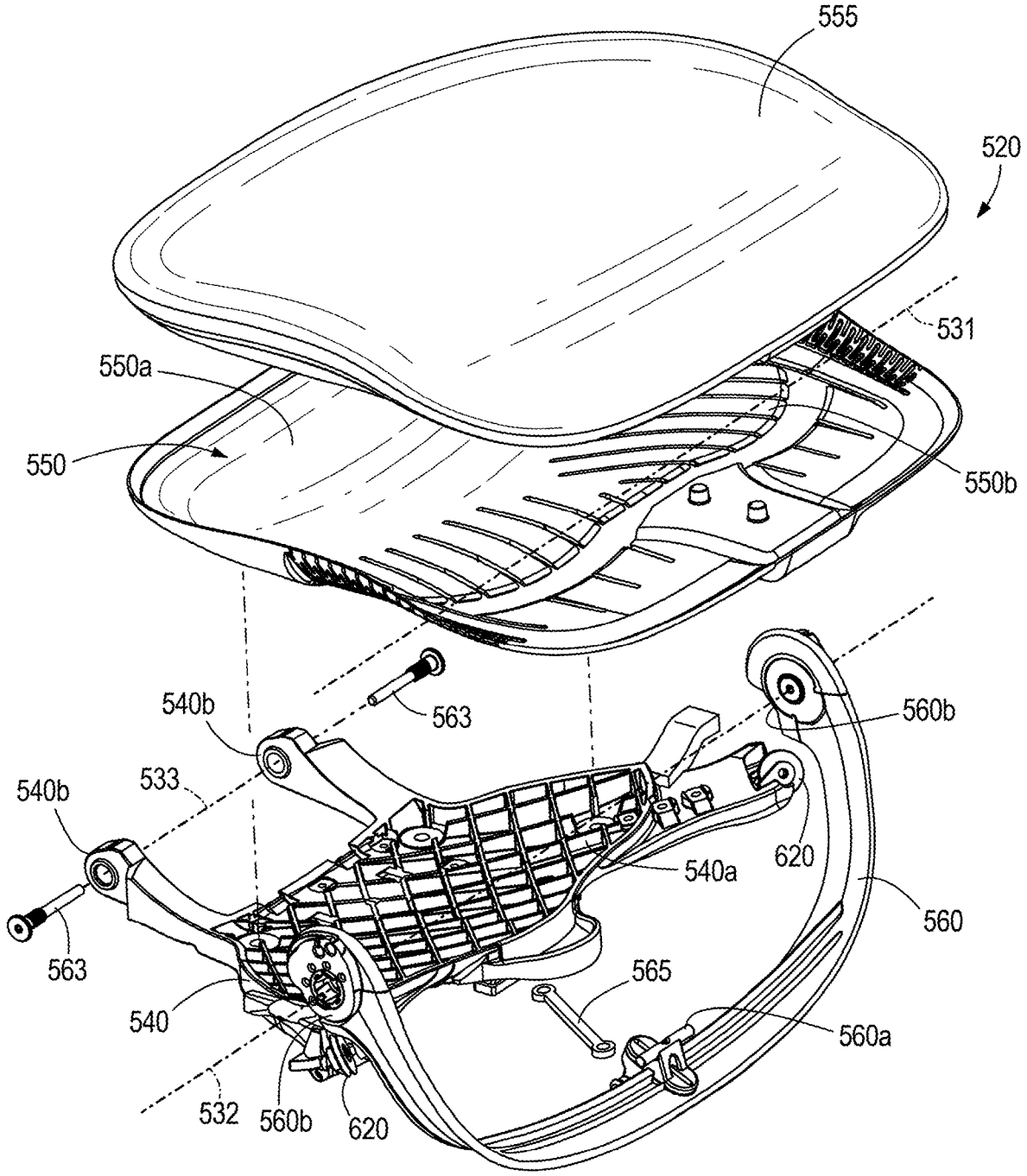
FIG. 13 is an exploded view of the seat assembly from a second perspective.

With reference to FIGS. 12 and 13, the major components of the seat assembly 520 are a seat pan 540, a semi-rigid plastic bottom layer or shell 550, and a padded top layer 555, and a thigh support 560. Seat assembly 520 is a relatively horizontal surface with specific shape, contour, location and compliance that positions, orients and supports the user's posterior thigh forward of the pelvic nest and thigh relief. Dynamic pressure applied from the seat assembly 520 on the user's posterior thighs supports the weight of the thighs and also activates the large muscles of the thighs. This dynamic pressure and thigh muscle activation assists the user to naturally leverage and balance the torso, spine and pelvis in a neutral posture. Pressure distribution with focal points at the posterior inferior femoral region of the thigh. Support surfaces and cushioning materials are adjacent to the focal points to distribute pressure on the thighs. Support surfaces and cushioning materials have interdependent flex, varying stiffness, specific shapes and orientations.

The seat pan 540 includes a pelvic nest 540*a* and a pair of rearwardly-extending seat pan arms 540*b*. The pelvic nest 540*a* is a relatively horizontal surface with specific shape, contour, location and compliance that positions and orients the seated user's inferior pelvis in the rear portion of the upper chair 120 without sliding out during ingress and chair motions. The pelvic nest 540*a* may also be referred to as a "seat nest" or a "seat pocket." The seat pan arms 540*b* are pivotably mounted to the body support frame 510 by way of a pivot pin 563 on each side. The pivot pins 563 define the posterior pivot axis 533. The posterior pivot axis 533 is at the rear of the seat pan 540 and the seat pan 540 pivots in front of the posterior pivot axis 533.

The bottom layer 550 and top layer 555 may be referred to as the cushion assembly 550, 555. The front part of the cushion assembly 550, 555 may be referred to as a thigh pad. The cushion assembly 500, 555 cooperates with the seat pan 540 to distribute pressure, with focal points at the user's ischial tuberosities. The cushion assembly 550, 555 includes support surfaces and cushioning materials adjacent to the focal points to distribute pressure on the user's body. Support surfaces and cushioning materials have interdependent flex, varying stiffness, specific shapes and orientations. Additionally, the cushion assembly 550, 555 includes rigid regions that support a large majority of a user's weight. The posterior pivot axis 533, about which the pelvic nest rotates, is positioned below the user's spine and rearward of the users ischial tuberosities.

The top layer 555 may be a foam cushion or a webbing depending on the desired application. The top layer 555 is secured to the bottom layer 550 to form the inseparable, unified cushion assembly 550, 555.

The bottom layer 550 includes a rear portion 550*a* that is fastened to the seat pan 540, a thigh relief portion 550*b*, and a thigh relief track 550*c* (FIG. 12) on the bottom front portion of the bottom layer 550. The thigh relief portion 550*b* is a flexible region with specific shape, contour, location and compliance, positioned forward of the seat pan 540 and rearward of the thigh support 560. The thigh relief portion 550*b* includes slits and other relief features that give the bottom layer 550 localized compliance forward of the seat pan 540. The thigh relief portion 550*b* distributes and reduces pressure on the underside of the user's thigh to improve comfort. Support surfaces and cushioning materials have interdependent flex, varying stiffness, specific shapes and orientations.

The thigh relief pivot axis 531 is a living hinge or flexible section provided by the combination of the resilient material of the bottom layer 550 and the arrangement of slits and other relief features in the thigh relief portion 550*b*. The thigh relief pivot axis 531 is forward of the hip pivot axis 532. Although illustrated as a line in the drawings, the thigh relief pivot axis 531 may in the commercial embodiment be a smooth curve of a section of the bottom layer 550. Referring to FIG. 12, the thigh relief track 550*c* is downwardly-facing and has sidewalls with undercuts which are used to couple the bottom layer 550 to the thigh support 560, as will be described below.

Referring now to FIGS. 10-12, the thigh support 560 is U-shaped and is pivotably mounted at each free end to the body support frame 510 at the hip pivot axis 532. The thigh support 560 extends downward and forward of the hip pivot axis 532. The thigh support 560 rotates around the hip pivot axis 532 to allow user ingress into the chair 100, and allow the user to increase the effective angle between the thighs and the torso in a range from 100°-130°. The range of motion of the thigh support 560 in an assembled chair is about 35° although in other embodiments it may pivot as much as 45° downward with respect to the pelvic nest.

The thigh support 560 includes an integral thigh slide connector 560*a* at the center of its base portion. The integral thigh slide connector 560*a* comprises a horizontal slide pin having free ends. The thigh slide connector 560*a* is received in the thigh relief track 550*c* on the underside of the bottom layer 550, with the free ends of the integral slide pin in the undercuts of the thigh relief track 550*c*. The thigh slide connector 560*a* is therefore captured in the thigh relief track 550*c* such that the thigh slide connector 560*a* can only slide linearly along the thigh relief track 550*c* (i.e., forward and rearward). The thigh slide connector 560*a* slides along the thigh relief track 550*c* while transferring forces perpendicular to the slide pin between the thigh support 560 and the bottom layer 550, to cause pivoting of the thigh relief portion 550*b* about the thigh pivot axis 531. Movement of the thigh slide connector 560*a* along the thigh relief track 550*c* avoids the transfer of force in forward and rearward directions (i.e., along the extent of the thigh relief track 550*c*) between the thigh slide connector 560*a* and the cushion assembly 550, 555. The thigh support 560 also has a hip cam 560*b* that is eccentric with the hip axis 532. As will be described in more detail below, the hip cam 560*b* is used by the nest actuator assembly to actuate the thigh support 560.

Referring to FIGS. 11-13, a thigh return spring 565 (also referred to as an ingress bungie) is connected at one end to the thigh support 560 and at an opposite end to the pelvic nest 540*a*. The thigh return spring 565 may take a number of forms, including an elastic cord as illustrated in the drawings, a tension spring, a torsion spring, or any suitable biasing member. The thigh return spring 565 applies a biasing moment to the thigh support 560 about the hip pivot axis 532. When the user exits the chair 100, this biasing moment rotates the thigh support 560 and cushion assembly 550, 555 to a generally downward angle of approximately 45° which is the ingress position. As the thigh support 560 pivots down under the influence of the thigh return spring 565, the thigh slide connector 560*a* applies a downward force on the front of the cushion assembly 550, 555. The biasing force of the thigh return spring 565 is sufficient to hold the cushion assembly 550, 555 in the ingress position when the chair 100 is unoccupied. In the ingress position, the front of the cushion assembly 550, 555 is pivoted down about the thigh relief pivot axis 531 to facilitate the user getting into or out of the chair 100 (in this regard, the ingress position can also be referred to as the egress position). With the front of the cushion assembly 550, 555 pivoted down, the user can more easily position the user's pelvis in the pelvic nest 540*a* (i.e., position the user's ischial tuberosities over the seat pan 540) before the chair 100 bears a substantial portion of the user's weight.

Figure 14:
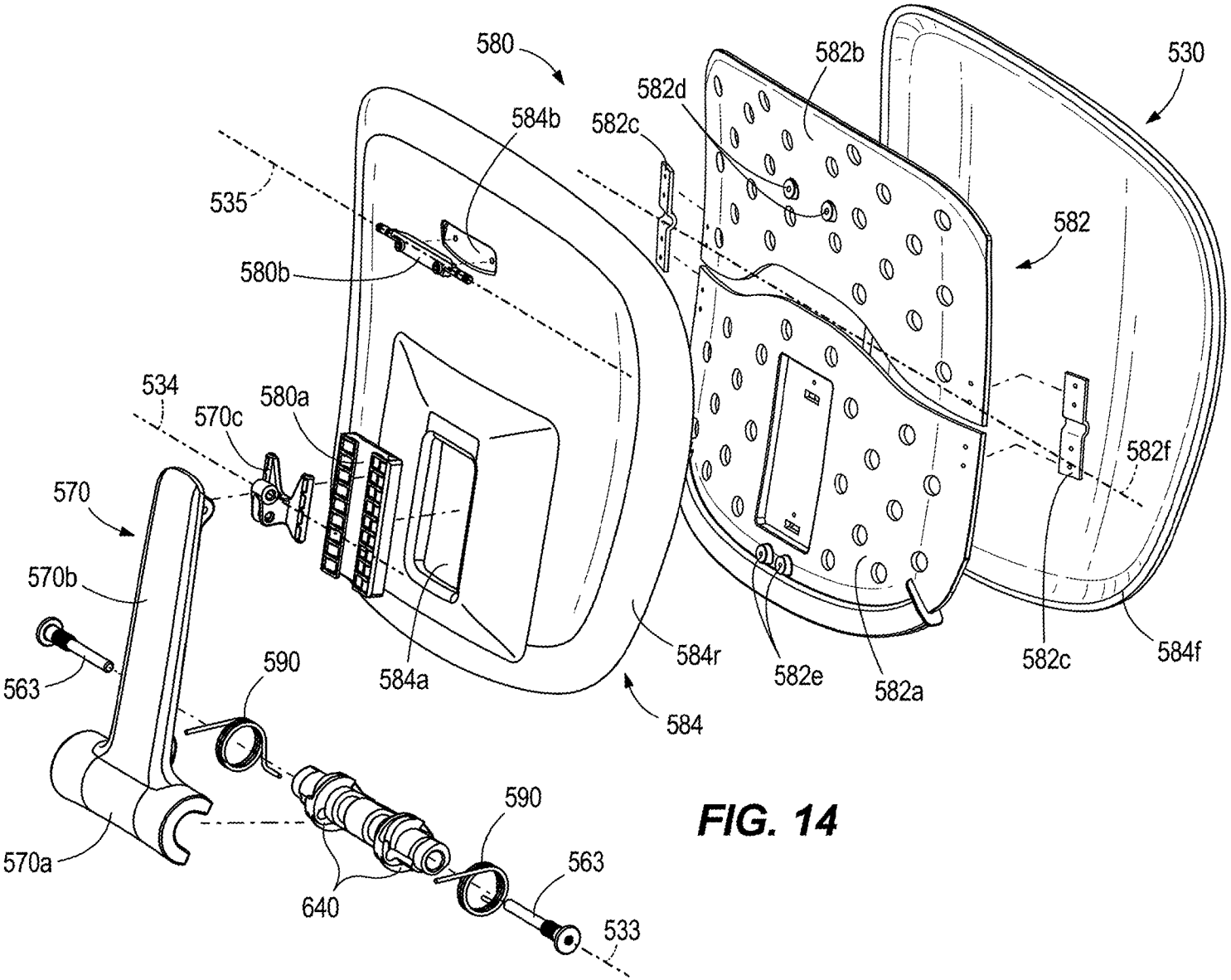
FIG. 14 is an exploded view of the back assembly.

With reference to FIG. 14, the major components of the back assembly 525 are a lower back support 570, a back pad assembly 580, and a lower back return spring 590. The back assembly 525 provides a relatively vertical surface with specific shape, contour, location and compliance that positions and orients the user's posterior sacrum and pelvis relative to the upper chair 120.

The lower back support 570 includes a hub 570*a* and an arm 570*b*. The hub 570*a* is at the bottom or base of the lower back support 570. The hub 570*a* is pivotably mounted to the body support frame 510 by way of the pivot pins 563 which extend through the arms 540*b* of the seat pan 540 and define the posterior pivot axis 533. The posterior pivot axis 533 is through the hub 570*a* at the bottom of the lower back support 570 and the arm 570*b* pivots above the posterior pivot axis 533. Additionally, the lower back support 570 pivots coaxially with the seat pan 540 about the posterior pivot axis 533 with respect to the body support frame 510. The arm 570*b* includes a lower back slide connector 570*c* pivotably mounted at the top end of the arm 570*a*. The lower back slide connector 570*c* includes wings, the significance of which will be explained below. The lower back return spring 590 is a torsion spring with two coils on opposite sides of the hub 570*a*, two free ends that bear against the body support frame 510, and a central portion that extends across the lower part of the arm 570*b* above the hub 570*a*. The lower back return spring 590 biases the lower back support 570 to the ingress position in which the lower back support 570 is pivoted rearwardly to open the pelvic nest 540*a* when the user enters and exits the chair 100.

As will be discussed in more detail below, pressure applied from the lower back support 570 on the user's sacrum prevents posterior rotation of the pelvis and spine kyphosis of a seated user. The lower back support 570 rotates fore/aft to accommodate variation in user's pelvic size and pelvis position, (i.e. the variation of the longitudinal distance from the ischial tuberosity to the sacral crest). The lower back support 570 has a forward stop position and a rearward stop position. The rotation range from the forward stop position to the rearward stop position is approximately 21 degrees (21°).

FIG. 14 also illustrates the back pad assembly 580. The back pad assembly 580 is a relatively vertical surface with specific shape, contour, location and compliance that positions, orients and supports the user's lower thoracic spine relative to the pelvic nest 540*a*. Pressure applied from the back pad assembly 580 on the user's lower thoracic spine supports the user's upper torso during off-loading on the back and helps maintain the natural curvature of the spine. Support surfaces and cushioning materials in the back pad assembly 580 are adjacent to the focal points to distribute pressure on the back. Support surfaces and cushioning materials have interdependent flex, varying stiffness, specific shapes and orientations.

With continued reference to FIG. 14, the back pad assembly 580 comprises a scaffold 582 and a case 584. In the illustrated embodiment, the scaffold 582 is embedded inside the case 584. The scaffold 582 includes a lower portion 582*a* to support the user's lower back, an upper portion 582*b* to support the user's upper back, and a springs defining a relief portion 582*c* interconnecting the lower and upper portions 582*a*, 582*b*. The lower and upper portions 582*a*, 582*b* pivot with respect to each other on the relief portion 582*c*. The relief portion 582*c* permits the seat user's upper and lower back regions to adjust with respect to each other in the fore and aft directions. The scaffold 582 also includes a pair of upper mounting bosses 582*d* and a pair of lower mounting bosses 582*e* which facilitate mounting the scaffold 582 to the case 584.

The case 584 includes a forward facing portion 584*f* against which the seat user's back rests and a rear facing portion 584*r* that includes a lower back cavity 584*a* and a window 584*b*. In the illustrated embodiment, the case 584 is shown in two pieces, with the forward facing portion 584*f* in front of the scaffold 582 and the rear facing portion 584*r* behind the scaffold 582. Alternatively, the case 584 can be overmolded onto the scaffold 582. In any event, the scaffold 582 is inside or embedded in the case 584. The illustrated embodiment is not limiting. The front portion 584*f* could take the form of a web or mesh material that is desirable for contact with the user's back. The rear portion 584*r* could be more rigid or solid than the front portion 584*f* to be most suitable for the functionality of the lower back cavity 584*a*, described below. Because the case 584 is mounted to the scaffold 582 such that the overall back pad assembly 580 functions as an integrated unit, the portions of the overall back pad assembly 580 corresponding to the lower, upper, and relief portions 582*a*, 582*b*, 582*c* of the scaffold 582 can be referred to as the respective lower, upper, and relief portions of the overall back pad assembly 580.

The back pad assembly 580 also includes a lower back track 580*a* received in the lower back cavity 584*a* and an upper pivot mount 580*b* mounted to the upper bosses 582*d* and extending through the window 584*b*. Both the lower back track 580*a* and the upper pivot mount 580*b* are on the rear-facing side of the case 584. The lower back track 580*a* includes side channels on opposite sides of a central slot. The side channels receive the wings of the lower back slide connector 570*c*. The side channels capture the wings of the lower back slide connector 570 to permit only vertical movement of the lower back slide connector 570*c* in the lower back track 584*a*. As noted above, however, the lower back slide connector 570*c* is pivotably connected to the top of the arm 570*b* of the lower back support 570.

As a result, the lower back support 570 and the lower back slide connector 570*c* pivot with respect to each other about the lower back pivot axis 534, and the lower back pivot axis 534 is vertically-adjustable. The lower back pivot axis 534 is a horizontal axis coincident to the center of pressure applied to the back pad assembly 580 by the user. The lower back pivot axis 534 permits pivotal movement of the lower portion 582*a* of the scaffold 582 with respect to the lower back support 570.

The upper pivot mount 580*b* includes an integral hinge pin in the illustrated embodiment. The upper pivot mount 580*b* cooperates with (i.e., is received by, in the illustrated embodiment) the upper pivot mount 510*c* of the back portion 510*b* of the body support frame 510. The upper pivot mount 580*b* of the back pad assembly 580 and the upper pivot mount 510*c* of the back portion 510*b* together form an upper pivot assembly that defines the thoracic pivot axis 535. The back pad assembly 580 (and more specifically the upper portion 582*b*) pivots about the thoracic pivot axis 535 to accommodate the angle of the user's thoracic region. The back pad assembly 580 is pivotably connected to the body support frame 510 at the horizontal thoracic pivot axis 535 for pivoting motion about the thoracic pivot axis 535. The upper pivot assembly 510*c*, 580*b* constrains the back pad assembly 580 against vertical linear movement with respect to the body support frame 510.

The relief portion 582*c* provides sufficient compliance in the back pad assembly 580 to permit the lower and upper portions 582*a*, 582*b* to pivot with respect to each other as the lower portion 582*a* pivots on the lower back pivot axis 534 and the upper portion 582*b* pivots on the thoracic pivot axis 535. This pivoting is about a mid-back pivot axis 582*f* in the relief portion 582*c*, and provides yet another degree of freedom for the upper chair 120. The mid-back pivot axis 582*f* is a horizontal pivot axis through the relief portion 582*c*.

Figure 15:
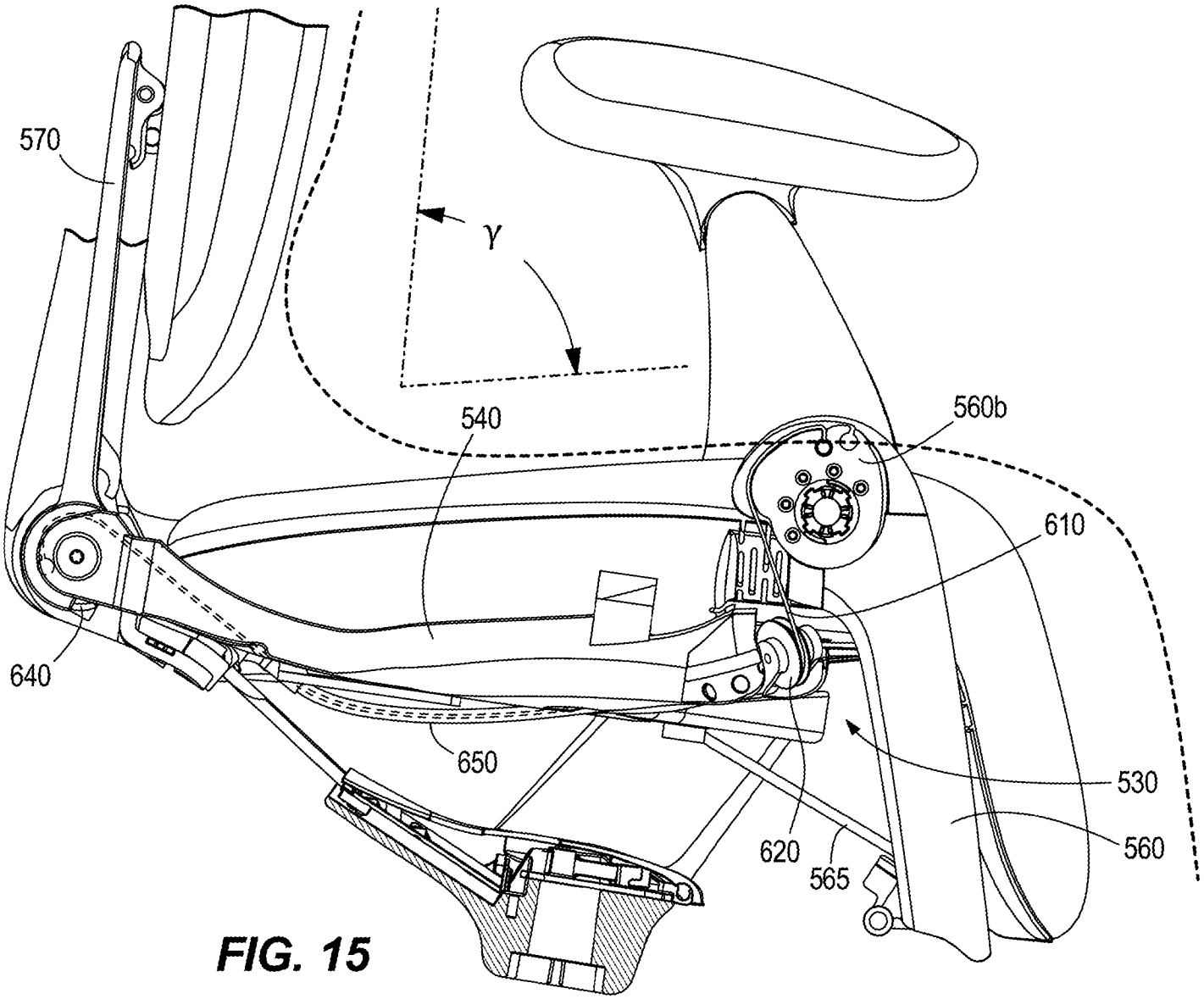
FIG. 15 is a side view of a nest actuator assembly in an ingress position.
Figure 16:
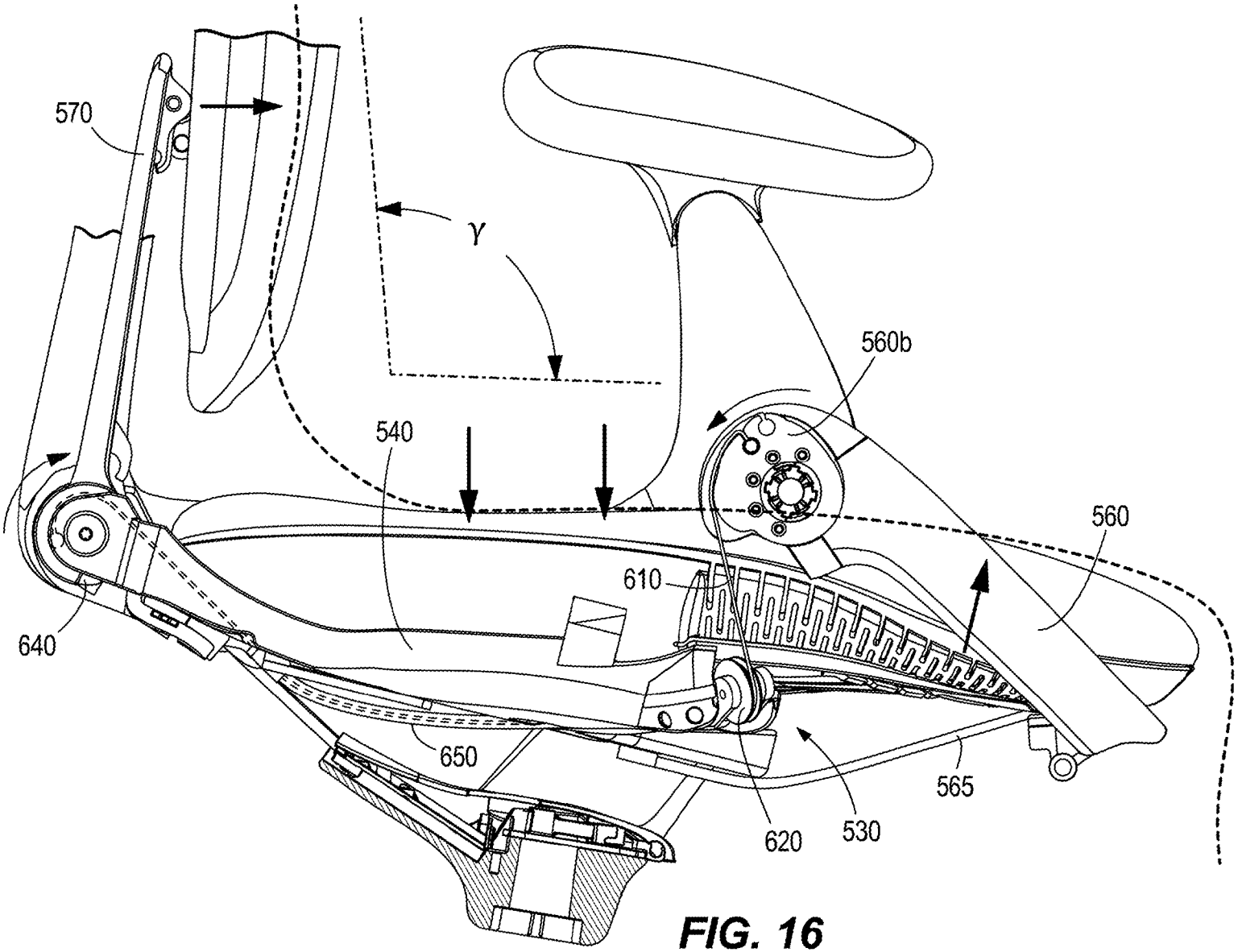
FIG. 16 is a side view of the nest actuator assembly in an engaged position.
Figure 17:
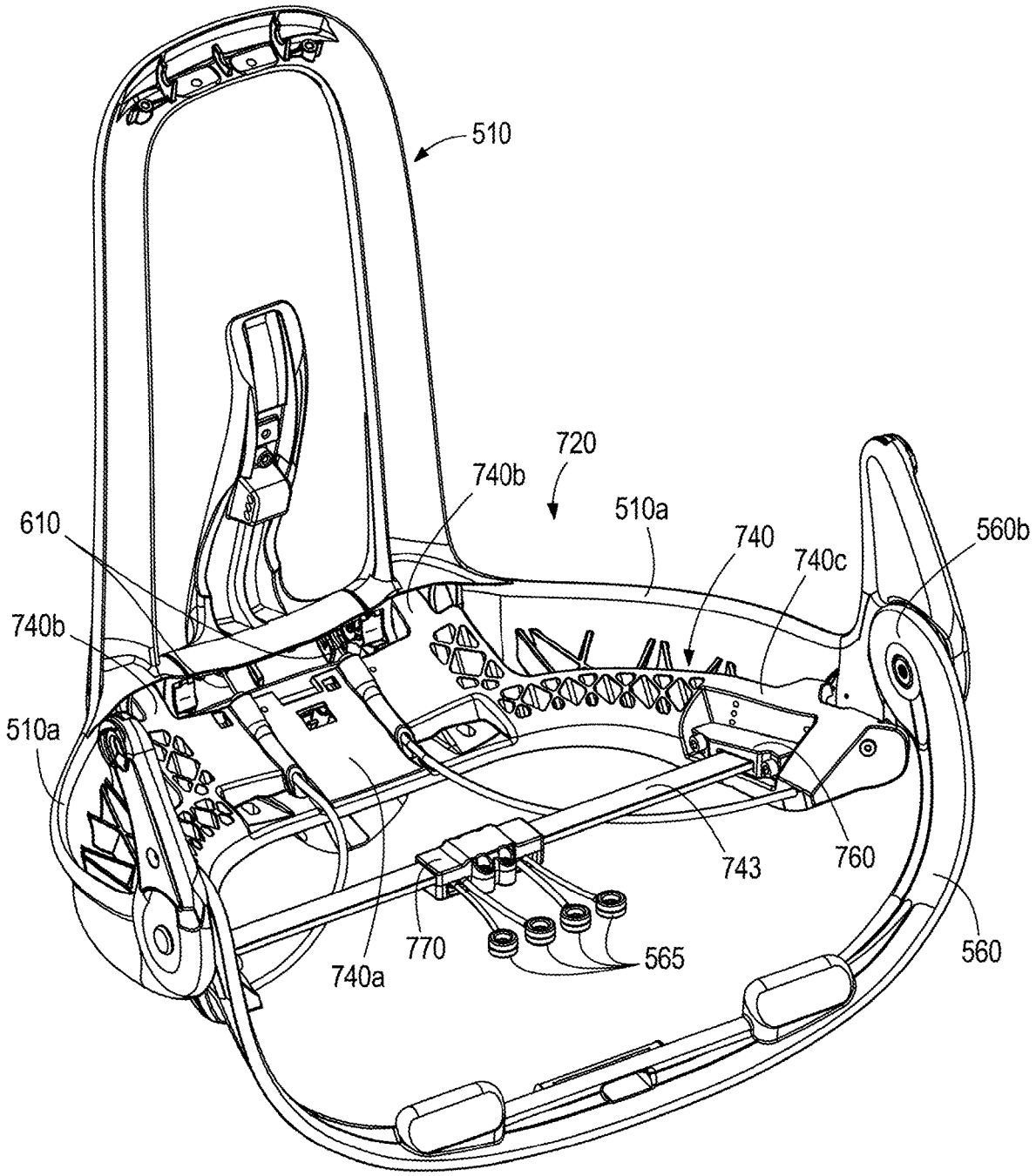
FIG. 17 is a perspective view of an alternative seat assembly.
Figure 18:
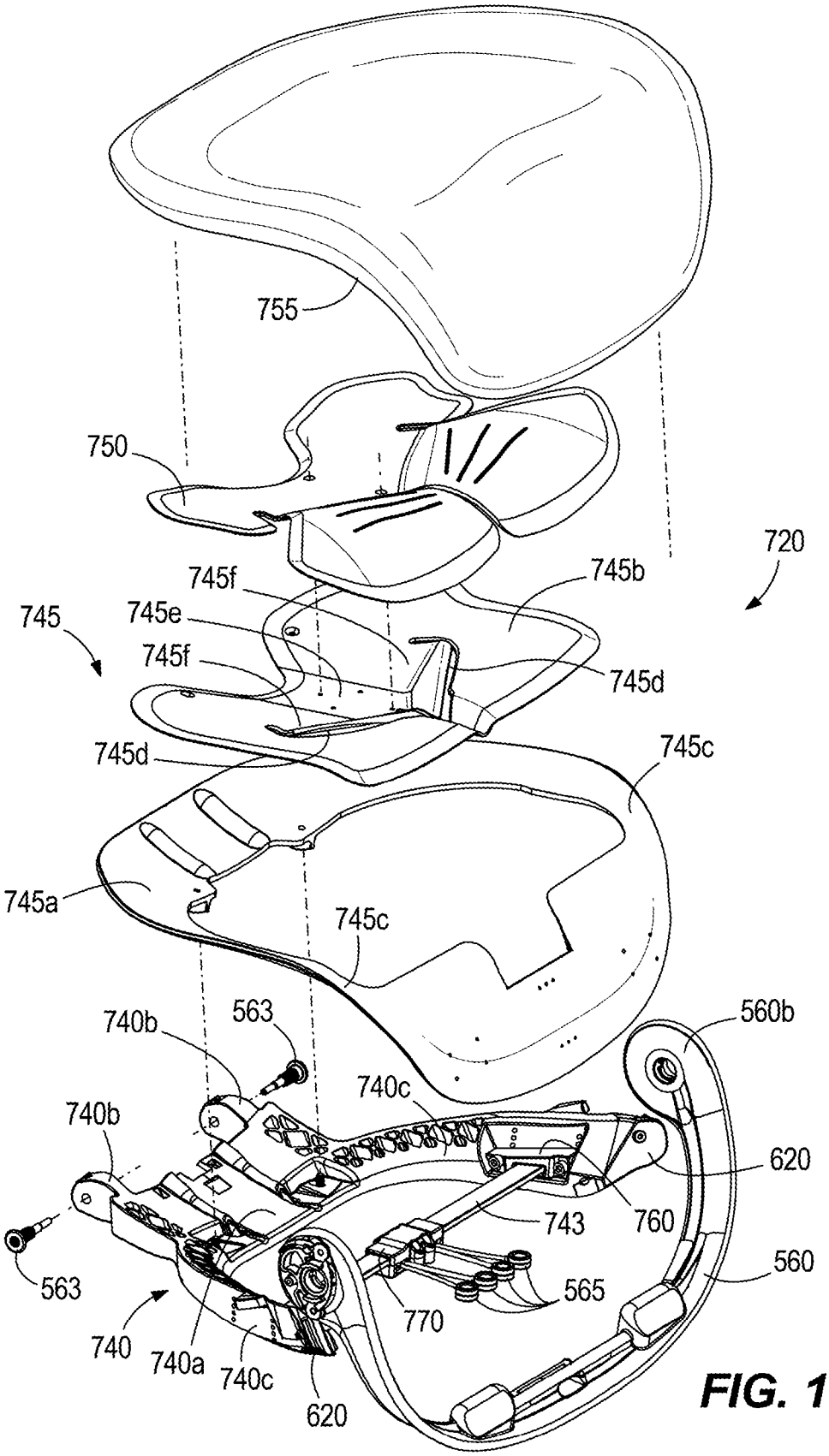
FIG. 18 is an exploded view of the alternative seat assembly.

Turning to FIGS. 15-16, the nest actuator assembly 530 includes the hip cam 560*b*, a nesting cable 610, a pulley 620, and a lower back cam 640. There is actually a nest actuator assembly 530 on both sides of the seat assembly 520, but only one is described, it being understood that the other nest actuator assembly 530 is a mirror image of the one described. The nesting cable 610 is fastened at one end to the hip cam 560*b* as illustrated in FIGS. 15 and 16, and extends over the surface of the hip cam 560*b*. From the hip cam 560*b*, the nesting cable 610 extends over the pulley 620 and rearward to the lower back cam 640. The opposite end of the nesting cable 610 is connected to the lower back cam 640 such that the nesting cable 610 extends over the surface of the lower back cam 640.

The pulley 620 is mounted to front (on one side) of the seat pan 540 to redirect the nesting cable 610 from being aligned with the hip cam 560*b* toward alignment with the lower back cam 560*b*. With additional reference to FIG. 14, the lower back cams 640 are part of an integral shaft that is mounted to the hub 570*a* of the lower back support 570. The shaft and lower back cams 640 are supported by the pivot pins 563. The lower back cams 640 are fixed for rotation (i.e., coupled) with the hub 570*a* about the posterior pivot axis 533, such that rotation of the lower back cam 640 causes rotation of the lower back support 570 and vice-versa.

A sheath 650 surrounds the nesting cable 610 under the seat pan 540. With reference to FIGS. 10 and 12, the sheath 650 is fixed or anchored at each end to the seat pan 540 near the front and rear of the seat pan 540. The sheath 650 guides the nesting cable 610 into alignment with the lower back cam 640. The nesting cable 610 moves within the sheath 650 while the sheath 650 stays in place. The nesting cable 610 and sheath 650 assembly is similar to the brake cables on a bicycle.

As illustrated in FIG. 15, when the chair 100 is in the ingress position, the thigh support 560 is pivoted down under the influence of the thigh return spring 565 and the lower back support 570 is pivoted rearward under the influence of the lower back return spring 590. The pelvic nest 540*a* is thus open and accessible to a user wishing to enter or sit on the chair 100. The same is true as the user gets up from or leaves the chair 100—the thigh return spring 565 and lower back return spring 590 open the pelvic nest 540*a* to facilitate the user's exit.

As seen in FIG. 16, when a user sits on the chair 100, the weight of the user pivots the seat pan 540 down about the posterior pivot axis 533. The downward movement pushes the nesting cable 610 down through the pulley 620, which generates tension in the nesting cable 610. The tension in the nesting cable 610 acts at one end on the hip cam surface 560*b* and at the opposite end on the lower back cam 640.

This tension, acting through the hip cam surface 560*b* and lower back cam 640, simultaneously applies moments to the thigh support 560 (about the hip pivot axis 532) and lower back support 570 (about the posterior pivot axis 533). The moments pivot the thigh support 560 up against the underside of the user's thighs and the lower back support 570 forward against the user's lower back (i.e., sacrum and lumbar region). The tension also opposes rotation of the pelvic nest 540 under the user's weight. The overall result of the action of the nest actuator assembly 530 is to apply opposing pressures on the underside of the user's thighs and on the user's lower back as the user's posterior is lowered on the seat pan 540. The user's weight is the actuating force on the nest actuator assembly. The hip cam surface 560*b* and lower back cam 640 and moment arms (e.g., the thigh support 560 and the lower back support 570) are design to generate the opposing pressures in desirable proportions to the user's weight. The respective upward pivoting of the thigh support 560 and the forward pivoting of the lower back support 570 may be referred to as the "engaged position" for those components.

Broadly speaking, the thigh support 560 and the lower back support 570 can be referred to as respective first and second components defining between them a receiving space for a user's pelvis, and the nesting actuator assembly 530 may be referred to as an actuator that moves the first and second components in directions that change the shape of the receiving space. The actuator can be said to cause the first component to engage the user's thighs and the second component to engage the user's lower back with a clamping force related to the weight of the user.

Alternative Upper Seat

FIGS. 17-20 illustrate an alternative seat assembly 720 which includes a seat frame 740, a beam 743, a seat pan 745, a seat pad 750, and a padded top layer 755. The seat assembly 720 basically replaces the seat assembly 520 described above and illustrated in FIGS. 11-13. Because all other components around the seat assembly 720 are the same or very similar, reference numbers from FIGS. 11-13 may be used in the description of this alternative seat assembly 720.

The seat frame 740 includes a base portion 740*a*, a pair of seat frame arms 740*b* extending rearward from the base portion 740*a*, and a pair of seat pan arms 740*c* extending forward from the base portion 740*a*. The seat frame 740 is relatively rigid. Suitable materials for construction of the seat frame 740 include but are not limited to aluminum and glass-filled nylon. The seat frame arms 740*b* are pivotably mounted to the body support frame 510 by way of the pivot pins 563. The seat pan arms 740*c* extend along opposite sides of the seat assembly 720. Each seat pan arm 740*c* includes one of the above-described pulleys 620 at its free forward end. As described above, the nesting cables 610 are routed through the pulleys 620 to the hip cams 560*b* on the horizontal seat portions 510*a* of the body support frame 510.

The beam 743 spans the space between the seat pan arms 740*c* a little closer to the free forward ends of the seat pan arms 740*c* than to the base portion 740*a*. The illustrated beam 743 is a composite spring. The beam 743 is wider than it is thick such that it has a relatively high moment of inertia about a vertical axis but can be bowed downward in the center under the weight of a seat user. The beam 743 is mounted at opposite ends to the seat pan arms 740*c* by way of mounting blocks 760. The mounting blocks 760 prevent significant movement of ends of the beam 743 transverse to its longitudinal extent, but permit the ends of the beam 743 to slide a small amount toward each other as the beam 743 is deflected downward in the middle. The mounting blocks 760 also permit the ends of the beam to slide away from each other while still being captured in the mounting blocks 760 as the beam 743 returns to its flat condition when the user's weight is removed. For example, in one construction there may be one millimeter (1 mm) of total play between the ends of the undeflected beam 743 and the mounting blocks 760 (i.e., the beam 743 may be 1 mm shorter than the width between contact points on the opposite seat pan arms 740*c*). The beam 743 may deflect, for example, one inch (1") downward at the center under the user's weight. A spring block 770 is affixed to the center of the beam 743. A plurality of thigh return springs 565 (as described above and illustrated in FIGS. 11-13) are connected at one end to the spring block 770 and at an opposite end to the thigh support 560. Because of the relatively high moment of inertia of the beam 743 about a vertical axis, the beam 743 is strongly resists any forwardly-directed (i.e., transverse to the vertical axis) biasing forces applied by the thigh return springs 565 to the beam 743.

The seat pan 745 includes a seat pan frame 745*a* and a pelvic nest 745*b*. Although illustrated as separate components, seat pan frame 745*a* and pelvic nest 745*b* are preferably molded from plastic as a single piece. The seat pan frame 745*a* defines a continuous rim around the seat pan 745. The seat pan frame 745*a* angles downward as it extends toward the center of the seat pan 745 to create a concave, dished or cupped border of the seat pan 745. Flexible side regions 745*c* of the seat pan frame 745*a* are highly flexible to permit the front portion of the seat pan frame 745*a* to pivot up and down with the thigh support 560 relative to the rear portion of the seat pan frame 745*a*. In the illustrated embodiment, the flexible side regions 745*c* may also be referred to as thin side regions. The front portions of the seat pan 745 frame 745*a*, seat pad 750, and padded top layer 755 (i.e., those portions forward of the flexible side regions 745*c*) may be referred to as a thigh pad in this embodiment.

A slit 745*d* is formed in a front portion of the pelvic nest 745*b* to separate the front edge of the pelvic nest 745*b* from a deflectable portion 745*e*. The slit 745*d* in combination with the thin, flexible side regions 745*c* provide a thigh relief portion interconnecting the pelvic nest 745*b* and the thigh pad for permitting compliant deflection of the thigh pad with respect to the pelvic nest 745*b*. The slit 745*d* gives the deflectable portion 745*e* the freedom to resiliently deflect down with respect to the seat pan frame 745*a* under the weight of a seated user. The resilient material of the pelvic nest 745*b* biases the deflectable portion 745*e* back to its at-rest condition when the user's weight is removed. As a result, the deflectable portion 745*e* of the pelvic nest 745*a* applies a generally upward biasing force against the bottom of a seated user.

The deflectable portion 745*e* includes IT panels 745*f* that receive the ischial tuberosities of the seated user. The IT panels 745*f* are angled slightly toward each other such that the reactive forces F (FIG. 20) applied to the ischial tuberosities of a seated user converge from the two sides on the sacrum of the seated user. This simulates the naturally-occurring forces on the ischial tuberosities when the user is standing and gives the seated user a similar sense of support.

The seat pad 750 is a plastic layer that overlays the pelvic nest 745*a* and spans the slit 745*d* to the front portion of the seat pan frame 745*a*. The seat pad 750 is made of a plastic that is softer than the plastic of the seat pan 745. For example and without excluding other suitable materials, the seat pad 750 may be constructed of a thermoplastic elastomer (TPE) such as thermoplastic polyurethane (TPU). The seat pad 750 is rather thin but nonetheless has the effect of softening edges of the seat pan 745 and providing more conformance to the bottom of a user seated in the chair than the stiffer plastic from which the seat pan 745 is constructed. The padded top layer 755 is much the same as the top layer 555 described above. It may be a foam cushion or a webbing depending on the desired application.

The positioning of the beam 743 and the shape of the seat pan 745 steer the user's ischial tuberosities to the specific, desired position on the IT panels 745*e*. Because of its cupped shape, seat pan 745 only contacts the beam 743 in the middle of the beam, mostly on top of the spring block 770. The IT panels 745*e* are positioned rearward of the beam 743. The beam 743 and resilient seat pan 745 act as stacked springs to support the user through the ischial tuberosities. The ischial tuberosities never bottom out against anything but are instead always suspended on the springy support of the seat pan 745.

Figure 19:
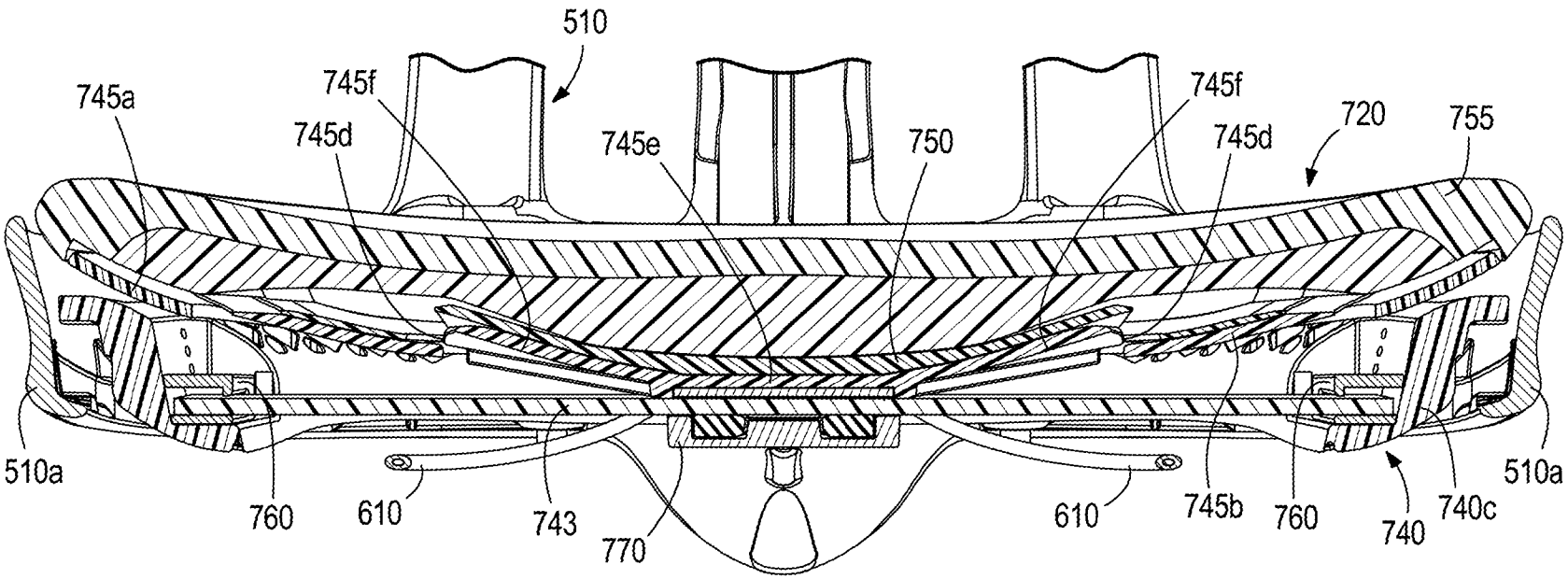
FIG. 19 is a cross section view of the alternative seat assembly in an at-rest condition.
Figure 20:
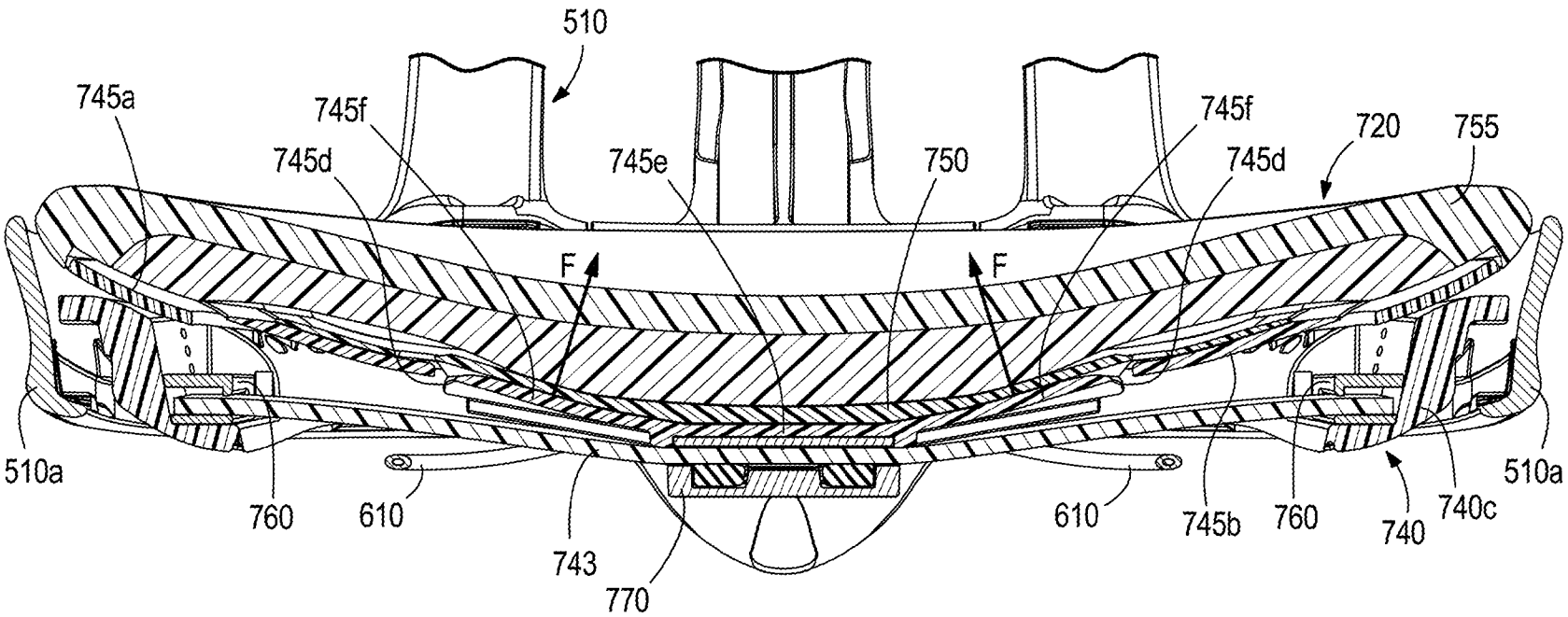
FIG. 20 is a cross section view of the alternative seat assembly in a deflected condition.

Referring to FIGS. 19-20, the seat pan 745, and specifically the deflectable portion 745*e*, contacts the center portion of the beam 743 when the seat is in an at-rest state (FIG. 19). When a user assumes a seated position (FIG. 20), the deflectable portion 745*e* and the beam 743 are deflected down under the weight of the user. The ends of the beam 743 slide in the mounting blocks 760 toward the center (i.e., toward each other) as the center of the beam 743 bows. The IT panels 745*f* do not touch the beam 743 such that the user's ischial tuberosities are supported above the beam 743 and cushioned by the inherent flex and resiliency of the IT panels 745*f*. The IT panels 745*f* provide a suspension for the user through the user's ischial tuberosities.

User Interaction

When the user activates the tilting motion (at the base), they can move fore/aft with very little effort and with controlled balance. This motion is activated and controlled by the forces of the feet applied to the floor. These forces on the feet also activate the muscles of the lower legs and thighs, which helps the body support the pelvis and spine in a neutral posture. Forward bias.

This gives the user the freedom to control and maintain their individual balance (which varies depending on user size, gender, and fitness level and the height they are working at).

When the user leans forward or reclines rearward, or tips their head forward or rearward, or extends and contracts their arms, or changes the position of their legs or feet, then these movements will change the user's mass distribution and reaction forces relative to the SI pivot axis. These changes in mass distribution and reaction forces will reorient/rotate the lower back support, pelvic support, thoracic support and thigh support around the SI pivot axis. This reorientation/rotation is controlled by the agonist/antagonist compliant resistance on the pelvic support and the reaction forces applied through the feet to the floor.

This gives the user the freedom to control and maintain their individual balance (which varies depending on user size, gender, and fitness level and the height they are working at).

When the user adjusts the seat height up/down, or extends their feet forward, or tucks their feet under their hips, then these movements will change the thigh/femur angle relative to the pelvis and will change the pressure distribution on the thigh support under the thighs. These changes in thigh angle and thigh support pressure will reorient/rotate the thigh support around the HIP pivot axis. This reorientation/rotation is controlled by the agonist/antagonist compliant resistance on the thigh support, the pressure applied by the thighs to the thigh support, and the reaction forces applied through the feet to the floor. This reorientation/rotation of the thigh support will also change the reaction forces to the pelvic support through the HIP pivot axis and HIP pivot resistance, causing the pelvic support, lower back support, thoracic support and thigh support to reorient/rotate around the SI pivot axis.

This gives the user the freedom to control and maintain their individual balance (which varies depending on user size, gender, and fitness level and the height they are working at).

Thus, the invention provides, among other things, a chair having an upper chair and a lower chair, the upper chair including a pelvic nesting actuator. Various features and advantages of the invention are set forth in the following claims.

The invention claimed is:

1. An upper chair adapted to be supported by a lower chair, the upper chair comprising:

a seat including a pelvic nest adapted to cradle the ischial tuberosities of a user;

a thigh pad engaging the user's posterior thighs forward of the pelvic nest;

a thigh relief interconnecting the pelvic nest and the thigh pad for permitting compliant deflection of the thigh pad with respect to the pelvic nest; and a lower back support pivotable with respect to the pelvic nest to engage a lower back of the user;

wherein a horizontal upper chair pivot axis is the sole pivotal interconnection between the upper chair and lower chair.

2. The upper chair of claim 1, wherein the upper chair includes a back and the horizontal upper chair pivot axis is above the seat and forward of the back.

3. The upper chair of claim 1, further comprising a back extending up with respect to the seat, at least a portion of the back having a 21° range of pivotable motion with respect to the seat.

4. The upper chair of claim 1, further comprising a back extending up with respect to the seat, the upper chair pivot axis being forward of the back.

5. The upper chair of claim 1, further comprising a back pad assembly extending up with respect to the seat and including upper and lower portions, the lower portion of the back pad assembly supported by the lower back support and movable with the lower back support with respect to the upper portion of the back pad and with respect to the pelvic nest.

6. The upper chair of claim 5, wherein the thigh pad pivots downward with respect to the pelvic nest no more than 45°.

7. The upper chair of claim 5, wherein the pelvic nest positions the user's ischial tuberosities below the upper chair pivot axis.

8. The upper chair of claim 5, wherein the thigh relief distributes and reduces pressures on portions of the user's posterior thighs positioned over the thigh relief.

9. The upper chair of claim 5, wherein an ingress condition of the upper chair comprises the thigh pad being pivoted downward with respect to the pelvic nest and the lower back support and lower portion of the back pad assembly being pivoted rearward with respect to the pelvic nest; and an engaged condition of the chair comprises the thigh pad being pivoted upward with respect to the pelvic nest and the lower back support and lower portion of the back pad assembly being pivoted forward with respect to the pelvic nest.

10. The upper chair of claim 9, wherein when the chair is in the engaged condition the thigh pad applies dynamic pressure on the user's posterior thighs to activate muscles in the user's thighs and thereby assist the user to naturally leverage and balance a torso, spine, and pelvis of the user in a neutral posture.

11. The upper chair of claim 9, wherein when the chair is in the engaged condition the lower portion of the back pad assembly applies dynamic pressure on the user's sacrum to resist posterior rotation of the user's pelvis.

12. The upper chair of claim 9, further comprising a thigh return spring biasing the thigh pad into the ingress position and a sacral return spring biasing the lower back support into the ingress position.

13. The upper chair of claim 9, wherein the lower portion of the back pad assembly is pivotably and slidably mounted to the lower back support about a sliding lower back pivot axis; and pivotal movement of the lower back support member applies a linear force on the lower portion of the back pad assembly perpendicular to the sacral sliding pivot axis to move the lower portion of the back pad assembly between the ingress position and engaged position.

14. The upper chair of claim 13, wherein the sacral sliding pivot axis is horizontal and coincident to a center of pressure applied to the lower portion of the back pad assembly by the user such that the lower portion of the back pad assembly is free to pivot about the sacral sliding pivot axis to orient the lower portion of the back pad assembly to an angle of the user's sacrum.

15. The upper chair of claim 9, further comprising a pulley mounted under the pelvic nest, a nesting cable interconnected at opposite ends to the thigh pad and the lower back support, the nesting cable extending over the pulley such that downward force on the pelvic nest arising from the user sitting in the pelvic nest generates tension in the nesting cable to pivot each of the thigh pad and the lower back support into the engaged condition.

16. The upper chair of claim 15, wherein: the lower back support pivots about a posterior pivot axis below and rearward of the upper chair pivot axis; the lower back support includes a lower back cam surface through which the posterior pivot axis extends; a first end of the nesting cable is connected to the lower back support; and the nesting cable engages the lower back cam surface such that tension in the nesting cable generates a moment on the lower back support about the posterior pivot axis to move the lower portion of the back pad assembly into the engaged position.

17. The upper chair of claim 16, wherein the lower back support has a 21° range of pivotable motion with respect to the posterior pivot axis.

18. The upper chair of claim 16, wherein the upper chair includes a body support frame pivotably mounted to the lower chair about the upper chair pivot axis, the body support frame extending below the seat and behind the back, the seat being supported by the body support frame, the upper portion of the back pivoting with respect to the body support frame about the thoracic pivot axis.

19. The upper chair of claim 18, further comprising a thigh support pivotably interconnected to the body support frame about a horizontal hip pivot axis that is below and forward of the upper chair pivot axis, the thigh pad being interconnected with the thigh support via a thigh pad sliding pivot axis under the thigh pad to enable relative rotation and translation between the thigh pad and thigh support.

20. The upper chair of claim 19, wherein: the thigh support includes a hip cam surface that is eccentrically positioned on the hip pivot axis; a second end of the nesting cable connects to the thigh support; and the nesting cable engages the hip cam surface such that tension in the nesting cable generates a moment on the thigh support about the hip pivot axis to move the thigh pad into the engaged position.

21. The upper chair of claim 18, further comprising at least one travel stop for limiting the total rotation of the of the body support frame with respect to the yoke about the upper chair pivot axis to a total range of 12°.

22. A chair comprising:

a lower chair including a tilt-swivel mechanism defining a vertical swivel axis, a yoke, and a column extending between the tilt-swivel mechanism and the yoke; and an upper chair pivotably mounted to the yoke about a horizontal upper chair pivot axis, the upper chair including a seat adapted to cradle the ischial tuberosities of a user;

wherein the horizontal upper chair pivot axis is above the seat.

23. The chair of claim 22, wherein:

the tilt-swivel mechanism includes a four-bar linkage rotatable about the swivel axis, the four-bar linkage including a coupler member that moves about a coupler curve; and a bottom end of the column is supported by the coupler member for movement with the coupler member about the coupler curve and rotation about the swivel axis.

24. The chair of claim 22, wherein the column defines a longitudinal axis angled with respect to the swivel axis and intersecting the swivel axis.

25. The chair of claim 24, wherein the column is locked with respect to the tilt- swivel mechanism against rotation about the longitudinal axis.

26. The chair of claim 24, wherein the tilt-swivel mechanism provides independent swivel and tilting actions for the column.

27. The chair of claim 24, wherein a tilting range of motion of the column on the tilt-swivel mechanism is limited to between 80-90° with respect to horizontal.

28. The chair of claim 24, wherein a tilting range of motion of the column on the tilt-swivel mechanism is limited to between 82-87° with respect to horizontal.

29. The chair of claim 24, wherein the tilt-swivel mechanism permits 360° of column swivel about the swivel axis.

30. The chair of claim 22, wherein the column is a height-adjustable column permitting adjustment of a distance between the yoke and the tilt-swivel mechanism.

31. The chair of claim 30, wherein the height-adjustable column accommodates users between the 5th and 95th percentile of sizes.

32. The chair of claim 30, wherein the height-adjustable column enables the user to sit in multiple tilted positions with a thigh-to-torso angle in the range of 90° to 130°.

33. The chair of claim 22, wherein the lower chair further comprises a base onto which the tilt-swivel mechanism is mounted and casters supporting the base above a floor, the casters enabling rolling motion of the chair on the floor.

34. The chair of claim 33, wherein a center of mass of the user is maintained over the base through a full range of motion afforded by the tilt-swivel mechanism.

35. The chair of claim 22, further comprising a biasing mechanism for moving the column into an at-rest position when the seat is not occupied by a user.

36. The chair of claim 22, wherein the upper chair pivot axis is the sole pivotal interconnection between the upper chair and lower chair.

37. The chair of claim 22, wherein a pivoting motion of the upper chair about the upper chair pivot axis is independent of tilt and swivel motions of the support column on the tilt-swivel mechanism.

38. The chair of claim 22, wherein the upper chair further comprises a back extending up with respect to the seat, at least a portion of the back having a 21° range of pivotable motion with respect to the seat.

39. The chair of claim 22, wherein the upper chair further comprises a back extending up with respect to the seat, the upper chair pivot axis being forward of the back.

40. A chair comprising:

a lower chair including a tilt-swivel mechanism defining a vertical swivel axis, a yoke, and a column extending between the tilt-swivel mechanism and the yoke; and an upper chair pivotably mounted to the yoke about a horizontal upper chair pivot axis, the upper chair including a seat adapted to cradle the ischial tuberosities of a user;

the seat comprises a pelvic nest for cradling the ischial tuberosities of the user, a thigh pad engaging the user's posterior thighs forward of the pelvic nest, and a thigh relief interconnecting the pelvic nest and the thigh pad for permitting compliant deflection of the thigh pad with respect to the pelvic nest; and the upper chair further comprises a back extending up with respect to the seat and including an upper portion and a lower portion, the upper and lower portions being pivotable with respect to each other.

41. The chair of claim 40, wherein the pelvic nest positions the user's ischial tuberosities below the upper chair pivot axis.

42. The chair of claim 40, wherein the upper chair pivots about the upper chair pivot axis to maintain the pelvic nest in a consistent attitude with respect to the user's ischial tuberosities through a range of tilting motion of the tilt-swivel mechanism, such that the user's ischial tuberosities are maintained in the pelvic nest through the range of motion.

43. The chair of claim 40, wherein the thigh pad has a 35° range of pivotable motion with respect to the pelvic nest.

44. The chair of claim 40, wherein the thigh relief distributes and reduces pressures on portions of the user's posterior thighs positioned over the thigh relief.

45. The chair of claim 40, wherein an ingress condition of the chair comprises the thigh pad being pivoted downward with respect to the pelvic nest and the back being pivoted rearward with respect to the pelvic nest; and an engaged condition of the chair comprises the thigh pad being pivoted upward with respect to the pelvic nest and the lower portion of the back being pivoted forward with respect to the pelvic nest.

46. The chair of claim 45, wherein when the chair is in the engaged condition the thigh pad applies dynamic pressure on the user's posterior thighs to activate muscles in the user's thighs and thereby assist the user to naturally leverage and balance a torso, spine, and pelvis of the user in a neutral posture.

47. The chair of claim 45, wherein when the chair is in the engaged condition the lower portion of the back engages the user's lumbar spine and sacrum to resist posterior rotation of the user's pelvis.

48. The chair of claim 45, chair further comprising a thigh return spring biasing the thigh pad into the ingress position and a sacral return spring biasing a lower back support into the ingress position.

49. The chair of claim 45, wherein the lower portion of the back is pivotably and slidably mounted to a lower back support about a sliding lower back pivot axis; and pivotal movement of the lower back support member applies a linear force on the lower portion of the back perpendicular to the sacral sliding pivot axis to move the lower portion of the back between the ingress position and engaged position.

50. The chair of claim 49, wherein the sacral sliding pivot axis is horizontal and coincident to a center of pressure applied to the lower portion of the back by the user such that the lower portion of the back is free to pivot about the sacral sliding pivot axis to orient the lower portion of the back to an angle of the user's lumbar spine and sacrum.

51. The chair of claim 49, further comprising a pulley mounted under the pelvic nest, a nesting cable interconnected at opposite ends to the thigh pad and the lower back support, the nesting cable extending over the pulley such that downward force on the pelvic nest arising from the user sitting in the pelvic nest generates tension in the nesting cable to pivot each of the thigh pad and the lower back support into the engaged condition.

52. The chair of claim 51, wherein: the lower back support pivots about a posterior pivot axis below and rearward of the upper chair pivot axis; the lower back support includes a lower back cam surface through which the posterior pivot axis extends; a first end of the nesting cable is connected to the lower back support; and the nesting cable engages the lower back cam surface such that tension in the nesting cable generates a moment on the lower back support about the posterior pivot axis to move the lower portion of the back into the engaged position.

53. The chair of claim 52, wherein the lower back support has a 21° range of pivotable motion with respect to the posterior pivot axis.

54. The chair of claim 51, wherein the upper chair includes a body support frame pivotably mounted to the yoke about the upper chair pivot axis, the body support frame extending below the seat and behind the back, the seat being supported by the body support frame, the upper portion of the back pivoting with respect to the body support frame about the thoracic pivot axis.

55. The chair of claim 54, further comprising a thigh support pivotably interconnected to the body support frame about a horizontal hip pivot axis that is below and forward of the upper chair pivot axis, the thigh pad being interconnected with the thigh support via a thigh pad sliding pivot axis under the thigh pad to enable relative rotation and translation between the thigh pad and thigh support.

56. The chair of claim 55, wherein: the thigh support includes a hip cam surface that is eccentrically positioned on the hip pivot axis; a second end of the nesting cable connects to the thigh support; and the nesting cable engages the hip cam surface such that tension in the nesting cable generates a moment on the thigh support about the hip pivot axis to move the thigh pad into the engaged position.

57. The chair of claim 54, further comprising at least one travel stop for limiting the total rotation of the of the body support frame with respect to the yoke about the upper chair pivot axis to a total range of 12°.

58. A chair comprising:

a lower chair including a tilt-swivel mechanism defining a vertical swivel axis, a yoke, and a column extending between the tilt-swivel mechanism and the yoke;

an upper chair pivotably mounted to the yoke about a horizontal upper chair pivot axis, the upper chair including a seat adapted to cradle the ischial tuberosities of a user; and a dampener between the column and tilt-swivel mechanism for controlling a rate of tilting motion of the column on the tilt-swivel mechanism and a dampener between the yoke and upper chair for controlling a rate of tilting motion of the upper chair with respect to the yoke about the upper pivot axis.

* * * * *